US012290136B2

(12) United States Patent
Tateno et al.

(10) Patent No.: US 12,290,136 B2
(45) Date of Patent: May 6, 2025

(54) SOLE AND SHOE INCLUDING SAME

(71) Applicant: ASICS CORPORATION, Kobe (JP)

(72) Inventors: Kenta Tateno, Hyogo (JP); Yousuke Atarashi, Hyogo (JP)

(73) Assignee: ASICS CORPORATION, Kobe (JP)

( * ) Notice: Subject to any disclaimer, the term of this patent is extended or adjusted under 35 U.S.C. 154(b) by 127 days.

(21) Appl. No.: 18/247,617

(22) PCT Filed: Oct. 9, 2020

(86) PCT No.: PCT/JP2020/038386

§ 371 (c)(1),
(2) Date: Mar. 31, 2023

(87) PCT Pub. No.: WO2022/074845

PCT Pub. Date: Apr. 14, 2022

(65) Prior Publication Data

US 2023/0380543 A1 Nov. 30, 2023

(51) Int. Cl.
*A43B 7/142* (2022.01)
*A43B 7/1445* (2022.01)
(Continued)

(52) U.S. Cl.
CPC ..... *A43B 13/187* (2013.01); *A43B 7/142* (2013.01); *A43B 7/1445* (2013.01); *A43B 13/12* (2013.01)

(58) Field of Classification Search
CPC ..... A43B 13/187; A43B 13/12; A43B 13/127; A43B 13/16; A43B 7/142; A43B 7/1445
(Continued)

(56) References Cited

U.S. PATENT DOCUMENTS 4,798,010 A * 1/1989 Sugiyama ..... A43B 13/187 36/31
5,025,573 A 6/1991 Giese et al.
(Continued)

FOREIGN PATENT DOCUMENTS

JP S64-500491 A 2/1989
JP H11-42103 A 2/1999
(Continued)

OTHER PUBLICATIONS

International Search Report issued in PCT/JP2020/038386; mailed Dec. 1, 2020.

*Primary Examiner* — Marie D Bays
(74) *Attorney, Agent, or Firm* — Studebaker Brackett PLLC

(57) ABSTRACT

There is provided a sole having a forefoot support portion supporting a forefoot of a foot of a wearer, a midfoot support portion supporting a midfoot of the foot, and a rearfoot support portion supporting a rearfoot of the foot, the forefoot support portion, the midfoot support portion, and the rearfoot support portion being connected in this order from a front side, the sole including a midsole having cushioning property, in which the midsole includes a cushioning portion formed of a first foam material, and a torsion control portion formed of a second form material having higher hardness than the first foam material, and the torsion control portion includes a first portion extending in a front-rear direction over at least the entire midfoot support portion on a medial foot side, and a second portion extending obliquely rearward from the first portion toward a lateral foot side.

20 Claims, 21 Drawing Sheets

(51) Int. Cl.
*A43B 13/12* (2006.01)
*A43B 13/18* (2006.01)

(58) Field of Classification Search
USPC ..... 36/25 R
See application file for complete search history.

(56) References Cited

U.S. PATENT DOCUMENTS 6,061,929 A * 5/2000 Ritter ..... A43B 3/122 36/31
6,920,707 B1 * 7/2005 Greene ..... A43B 13/16 36/97
11,751,629 B1 * 9/2023 Morrison ..... A43B 13/12 36/43
2001/0001907 A1 5/2001 Luthi et al.
2003/0033733 A1 * 2/2003 Brooks ..... A43B 7/142 36/31
2003/0192202 A1 * 10/2003 Schoenborn ..... A43B 13/16 36/31
2004/0194351 A1 * 10/2004 Gallegos ..... A43C 15/02 36/44
2007/0017123 A1 * 1/2007 Scofield ..... A43B 13/12 36/43
2012/0233877 A1 * 9/2012 Swigart ..... A43B 7/142 36/28
2013/0000146 A1 * 1/2013 Brandstatter ..... A43B 7/142 36/28
2015/0082668 A1 * 3/2015 Nonogawa ..... A43B 7/144 36/30 R
2015/0223563 A1 * 8/2015 Liebeno ..... B29D 35/128 36/31
2016/0353838 A1 12/2016 Takeshita et al.
2018/0008000 A1 * 1/2018 Chanda ..... B33Y 80/00
2018/0192739 A1 * 7/2018 Granger ..... A43B 17/14
2019/0069634 A1 * 3/2019 Lucca ..... A43B 13/141
2019/0116928 A1 * 4/2019 Yahata ..... A43B 13/14
2019/0116929 A1 * 4/2019 Kurcinka ..... A43B 17/02
2020/0214389 A1 * 7/2020 Hatano ..... A43B 13/181
2023/0143450 A1 * 5/2023 Ponomarev ..... A43B 7/24 36/25 R
2023/0189926 A1 * 6/2023 Hardman ..... A43B 13/186 36/29
2023/0380543 A1 * 11/2023 Tateno ..... A43B 7/24
2024/0188675 A1 * 6/2024 Ishikawa ..... A43B 13/026

FOREIGN PATENT DOCUMENTS

JP 2000-225002 A 8/2000
JP 2017-000213 A 1/2017
JP 2020-110631 A 7/2020

* cited by examiner

SOLE AND SHOE INCLUDING SAME

FIELD

The present invention relates to a sole and a shoe including the same.

BACKGROUND

When a person runs, a phenomenon called pronation occurs in which the heel of a foot falls inward. Pronation is a natural function of a foot to mitigate an impact applied to the foot during landing by the heel appropriately falling inward immediately after landing.

There are individual differences in the falling degree of the heel of a foot due to pronation, and some people are prone to a phenomenon called "overpronation" in which the heel falls excessively inward, and other people are prone to a phenomenon called "underpronation" in which the heel falls insufficiently inward. Overpronation and underpronation cause running disorder or walking disorder. Therefore, a shoe for a runner is required to have a function of adjusting the falling degree of the heel of a foot.

For this reason, a sole has been developed in which a high stiffness portion is provided on the sole, thereby increasing the stability of a foot during landing and adjusting the falling degree of the heel of the foot.

Patent Literature 1 discloses a sole in which torsional stiffness around a long axis of the sole is increased by providing a stability element, which is a high stiffness portion having higher bending stiffness than other portions, along the front-rear direction of the sole, and thus stability during landing is increased.

CITATION LIST

Patent Literature

Patent Literature 1: JP 2000-225002 A

SUMMARY

Technical Problem

There are some known methods of running, such as a heel strike running method, a midfoot running method, and a forefoot running method. In the heel-strike running method, a stance phase includes a heel landing phase of landing on the heel of a foot, a full flat phase of landing on the entire sole, and a push-off phase of pushing off rearward in a plantarflexion state in this order. Therefore, a shoe for a heel-strike runner needs to deform in such a manner that the sole warps to follow the plantar flexion of the foot from the heel landing phase to the push-off phase in order to avoid discomfort to the wearer during running.

The sole disclosed in Patent Literature 1 is provided with the stability element as a whole from the toe to the heel, which makes it difficult for the sole to deform following plantarflexion of the foot from the heel landing phase to the push-off phase, and causes discomfort to the wearer during running. However, in the sole disclosed in Patent Literature 1, if the stability element is shortened in order to easily deform following plantarflexion of the foot, torsional stiffness around the long axis of the sole is reduced, and the effect in enhancing stability during landing is reduced. As described above, with the sole disclosed in Patent Literature 1, it has been difficult to provide a structure that easily deforms following plantarflexion of a foot while providing a function of adjusting the falling degree of the heel of the foot.

The present invention has been made in view of the above, and a purpose of the present invention is to obtain a sole that is capable of adjusting the falling degree of a heel of a foot and easily deforms following plantarflexion of the foot.

Solution to Problem

In order to solve the above problem and achieve the object, a sole having a forefoot support portion supporting a forefoot of a foot of a wearer, a midfoot support portion supporting a midfoot of the foot, and a rearfoot support portion supporting a rearfoot of the foot, the forefoot support portion, the midfoot support portion, and the rearfoot support portion being connected in this order from a front side, the sole comprising: a midsole having cushioning property, wherein the midsole includes: a cushioning portion formed of a first foam material; and a torsion control portion formed of a material having higher hardness than the first foam material, and the torsion control portion includes: a first portion extending in a front-rear direction over at least the entire midfoot support portion on a medial foot side; and a second portion extending obliquely rearward from the first portion toward a lateral foot side.

Advantageous Effects of Invention

A sole according to the present invention has effects of adjusting the falling degree of a heel of a foot and easily deforming following plantarflexion of the foot.

DESCRIPTION OF EMBODIMENTS

Figure 1:
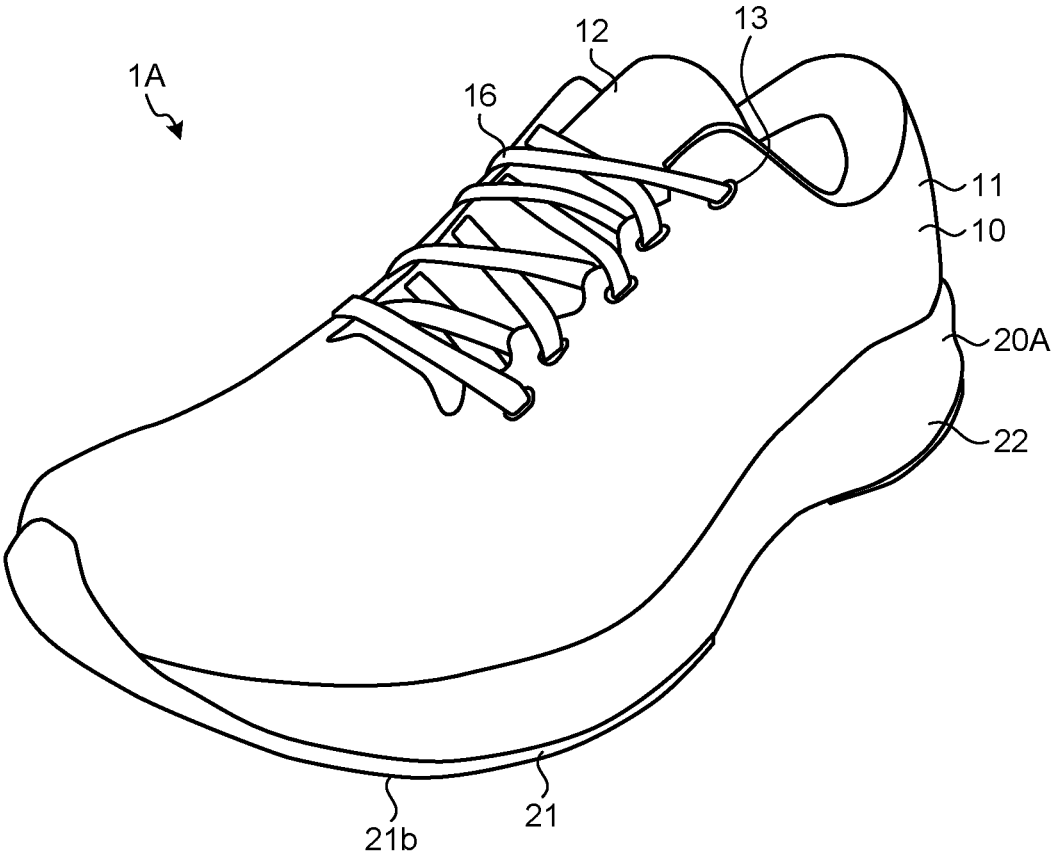
FIG. 1 is a perspective view of a shoe according to a first embodiment of the present invention.

Hereinafter, embodiments of a sole and a shoe according to the present invention will be described in detail with reference to the drawings. Note that the present invention is not limited by the embodiments. In the following embodiments, the same or common parts are denoted by the same reference signs, and the description thereof will not be repeated.

In the following embodiments, a direction in which a heel center axis, which is a perpendicular line passing through the heel center of a sole in a plan view of a shoe, extends is referred to as a front-rear direction, and a direction orthogonal to the front-rear direction in a plan view of the shoe is referred to as a foot-width direction.

In addition, of the front-rear direction, a direction directed from the end on the side where a portion of the sole supporting the rearfoot of a foot is positioned toward the end on the side where a portion of the sole supporting the forefoot of the foot is positioned is referred to as a front side, and of the front-rear direction, a direction directed from the end on the side where the portion of the sole supporting the forefoot of the foot is positioned toward the end on the side where the portion of the sole supporting the rearfoot of the foot is positioned is referred to as a rear side.

In addition, a median side of a foot in the anatomical position is referred to as a medial foot side, and the side opposite to the median side of the foot in the anatomical position is referred to as a lateral foot side. That is, the side closer to the median line in the anatomical position is referred to as the medial foot side, and the side farther from the median line in the anatomical position is referred to as the lateral foot side.

In addition, a line connecting a position on the medial-foot-side edge of the sole and corresponding to 45% of the dimension from the front edge of the sole in the front-rear direction of the sole and a position on the lateral foot edge of the sole and corresponding to 55% of the dimension from the front edge of the sole in the front-rear direction of the sole is defined as a first boundary line, and a line connecting a position on the medial-foot-side edge of the sole and corresponding to 70% of the dimension from the front edge of the sole in the front-rear direction of the sole and a position on the lateral foot edge of the sole and corresponding to 70% of the dimension from the front edge of the sole in the front-rear direction of the sole is defined as a second boundary line. In this case, a portion of the sole positioned in front of the first boundary line is referred to as a forefoot support portion of the sole, a portion sandwiched between the first and second boundary lines is referred to as a midfoot support portion of the sole, and a portion positioned behind the second boundary line is referred to as a rearfoot support portion of the sole.

The forefoot support portion of the sole corresponds to a portion supporting the forefoot of a foot of a wearer with a standard body shape, the midfoot support portion corresponds to a portion supporting the midfoot of a foot of a wearer with a standard body shape, and the rearfoot support portion corresponds to a portion supporting the rearfoot of a foot of a wearer with a standard body shape. In other words, the first boundary line is a line roughly along the Lisfranc joint of a wearer with a standard body shape, and the second boundary line is a line roughly along the Chopart joint of a wearer with a standard body shape.

Furthermore, a height direction means a direction orthogonal to both the front-rear direction and the foot-width direction unless otherwise specified, and a thickness means a dimension in the height direction unless otherwise specified.

First Embodiment

FIG. 1 is a perspective view of a shoe according to a first embodiment of the present invention. A shoe 1A includes an upper 10 and a sole 20A. The upper 10 has a shape covering the entire part on the instep side of an inserted foot. The sole 20A is positioned below the upper 10 and covers the sole of the foot.

The upper 10 includes an upper body 11, a shoe tongue 12, and a shoelace 16. The shoe tongue 12 is fixed to the upper body 11.

The upper body 11 is provided with an upper opening for exposing an upper part of the ankle and a part of the instep of the foot. The upper opening of the upper body 11 has a peripheral edge provided with a plurality of holes 13. The shoe tongue 12 is fixed to the upper body 11 by sewing, welding, bonding, or a combination thereof in such a manner as to cover a portion of the upper opening provided in the upper body 11 for exposing a part of the instep of the foot. As the upper body 11 and the shoe tongue 12, woven fabric, knitted fabric, synthetic leather, or resin is used. In particular, for a shoe required to have air permeability and lightweight property, a double raschel warp knitted fabric knitted with polyester yarn is used as the upper body 11 and the shoe tongue 12. Note that the material of the upper body 11 and the shoe tongue 12 is not limited to those exemplified.

The shoelace 16 is a string-like member and is inserted through the plurality of holes 13 of the upper body 11 to be detachably attached to the upper body 11. The shoelace 16 inserted through the plurality of holes 13 pulls the peripheral edge of the upper opening of the upper body 11 toward each other in the foot-width direction. By tightening the shoelace 16 while a foot is inserted in the upper body 11, it is possible to bring the upper body 11 into close contact with the foot.

In this embodiment, the upper 10 including the shoe tongue 12 and the shoelace 16 is described as an example, but the upper 10 may have a monosock structure in which a portion corresponding to the shoe tongue 12 is integrated with an ankle portion of the upper body 11. In addition, a hook-and-loop fastener may be used instead of the shoelace 16 to bring the upper body 11 into close contact with a foot.

If a hook-and-loop fastener is used to bring the upper body 11 into close contact with a foot, the plurality of holes 13 is not formed in the upper body 11.

The sole 20A includes an outsole 21 and a midsole 22. The lower surface of the outsole 21 serves as a ground contact surface 21*b* that is landed on the ground. The midsole 22 has cushioning property and is positioned above the outsole 21. Note that the outsole 21 may be integrated with the midsole 22. The midsole 22 integrated with the outsole 21 is also referred to as a "unisole".

The sole 20A further includes an inner sole (not illustrated) that covers a lower opening of the upper body 11. The inner sole is fixed to an upper surface 22*a* of the midsole 22 by bonding or welding. Alternatively, the inner sole is fixed to the lower edge of the above-described upper body 11 by stitching. Note that the sole 20A may have a structure in which the inner sole is omitted.

The shoe 1A may include an insole. If the shoe 1A includes an insole, the insole is installed on the sole 20A inside the upper 10.

Figure 2:
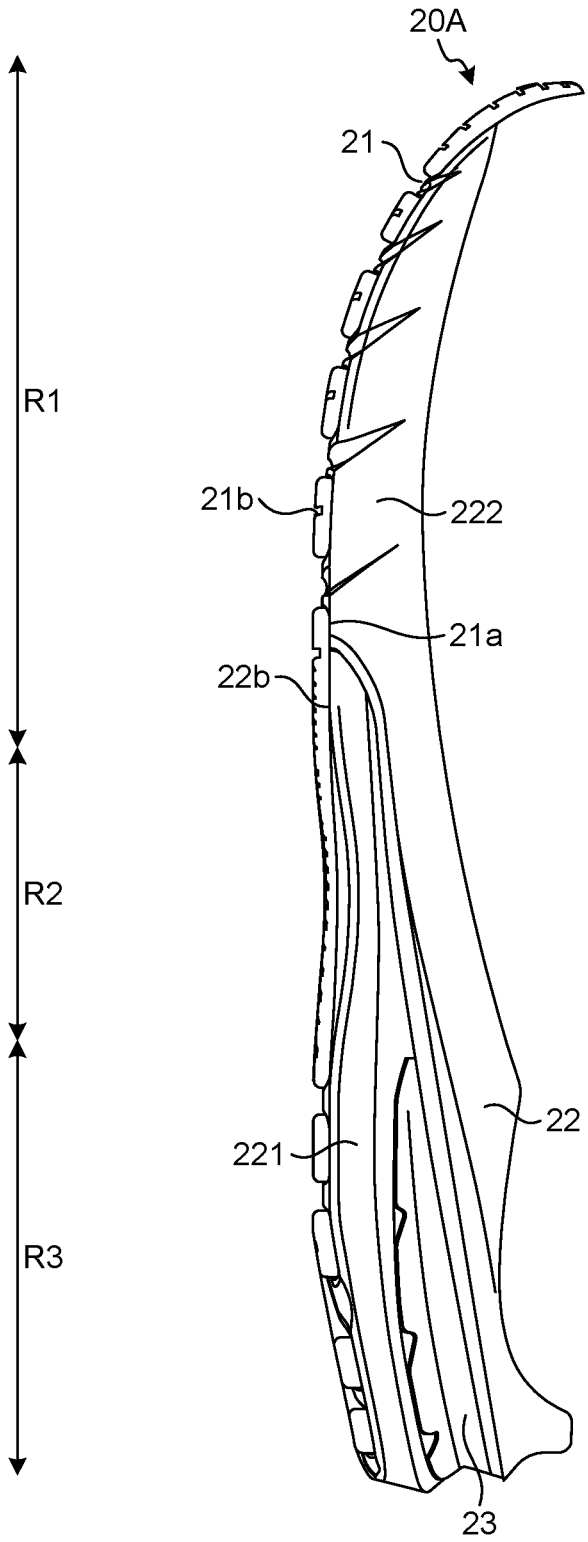
FIG. 2 is a side view of a sole on a lateral foot side according to the first embodiment.
Figure 3:
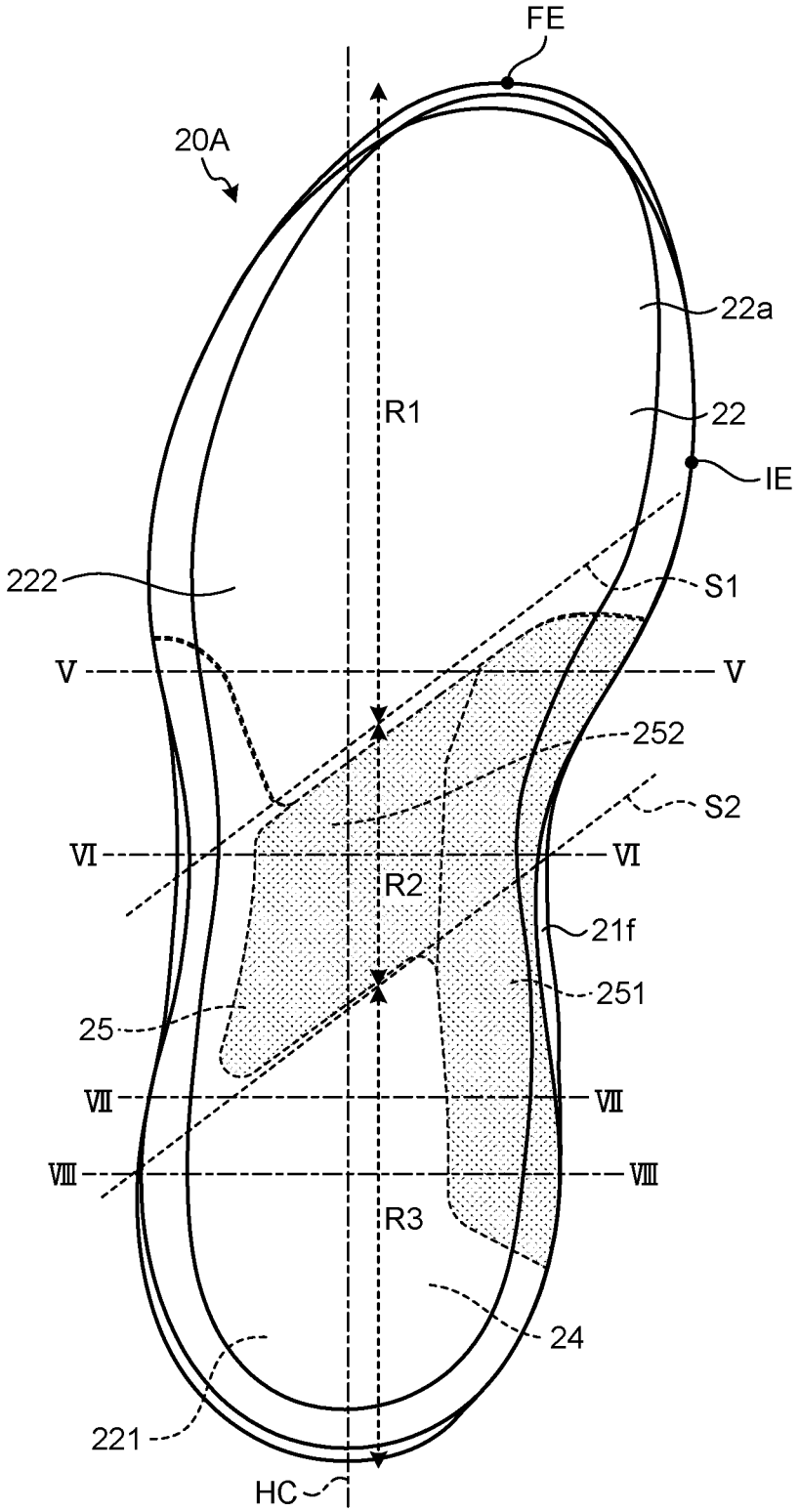
FIG. 3 is a top view of the sole according to the first embodiment.
Figure 4:
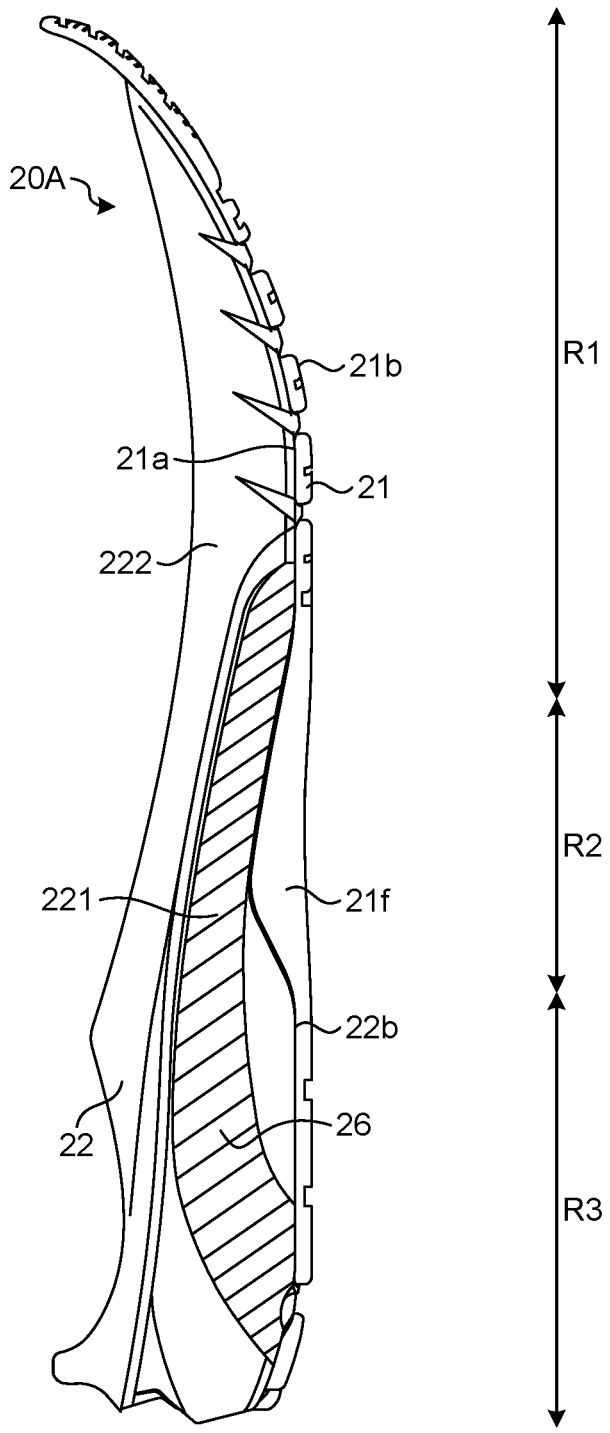
FIG. 4 is a side view of the sole on a medial foot side according to the first embodiment.
Figure 5:
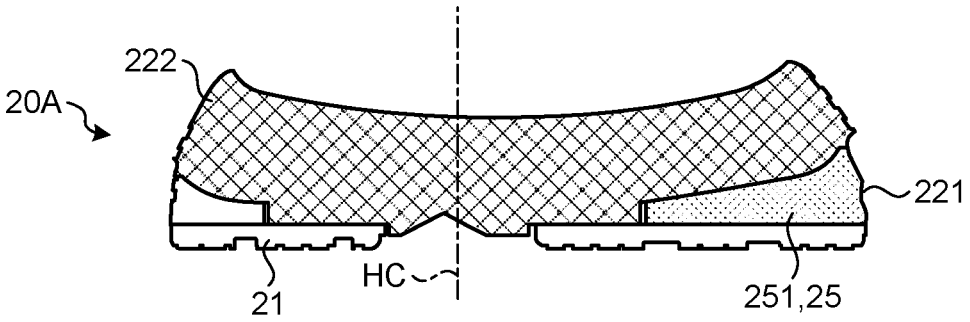
FIG. 5 is a cross-sectional view of the sole according to the first embodiment.
Figure 6:
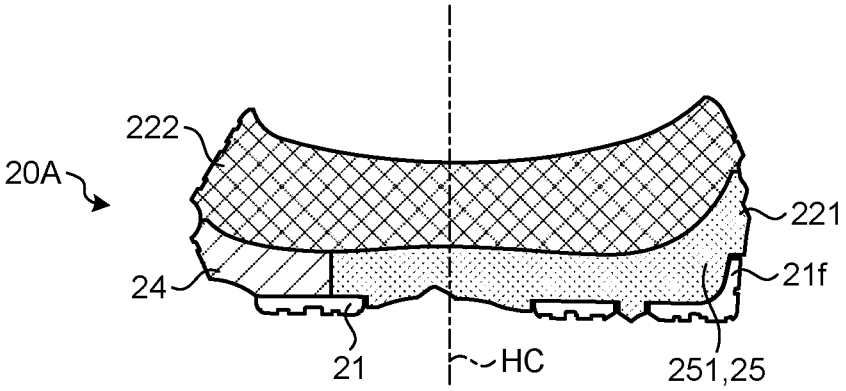
FIG. 6 is a cross-sectional view of the sole according to the first embodiment.
Figure 7:
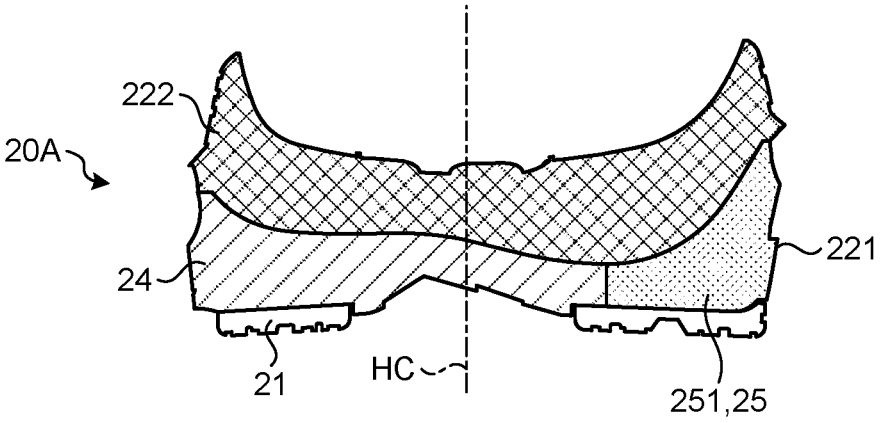
FIG. 7 is a cross-sectional view of the sole according to the first embodiment.
Figure 8:
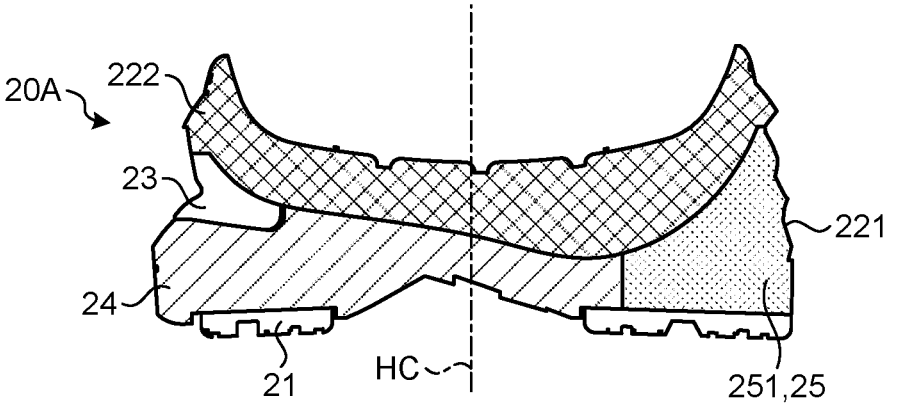
FIG. 8 is a cross-sectional view of the sole according to the first embodiment.
Figure 9:
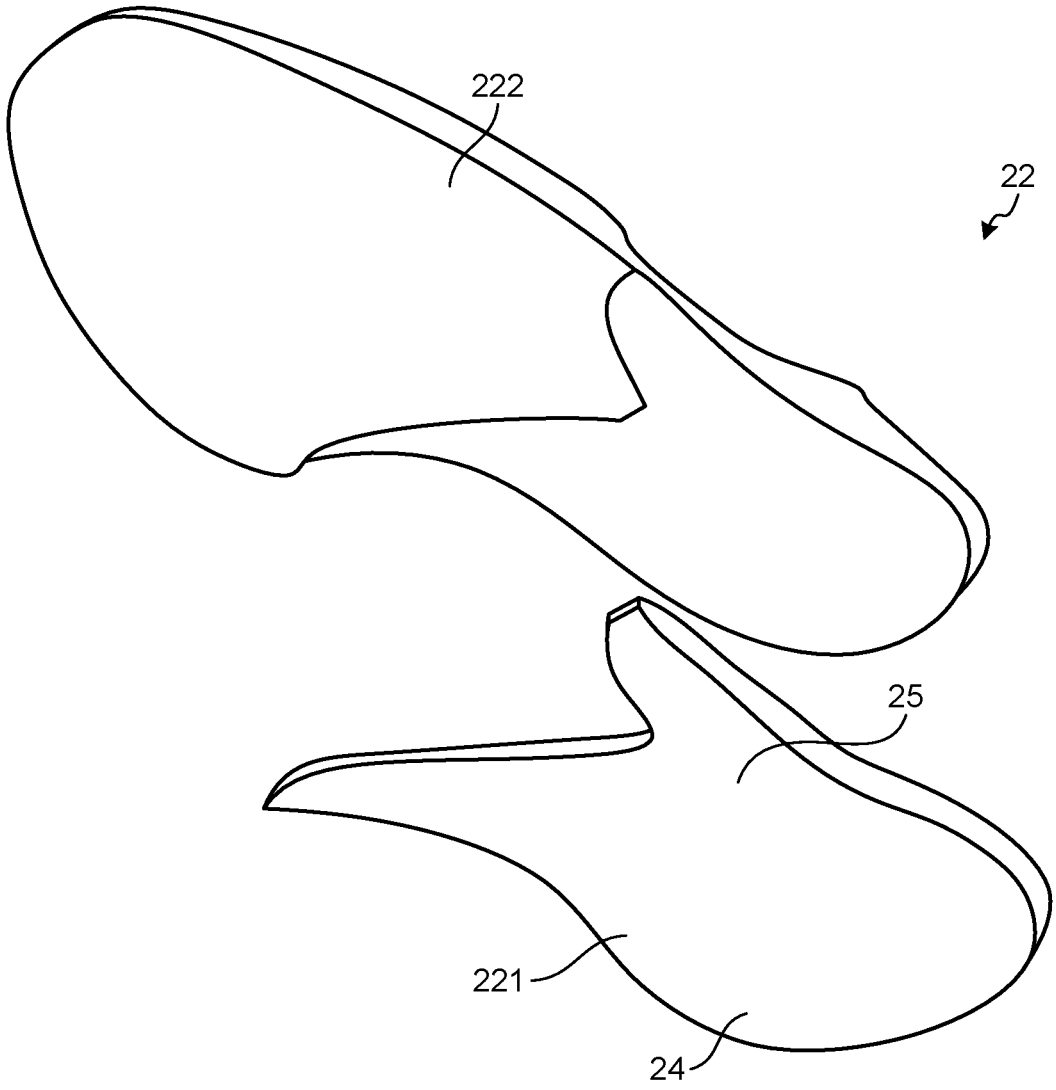
FIG. 9 is an exploded sectional view of a midsole of the sole according to the first embodiment.
Figure 10:
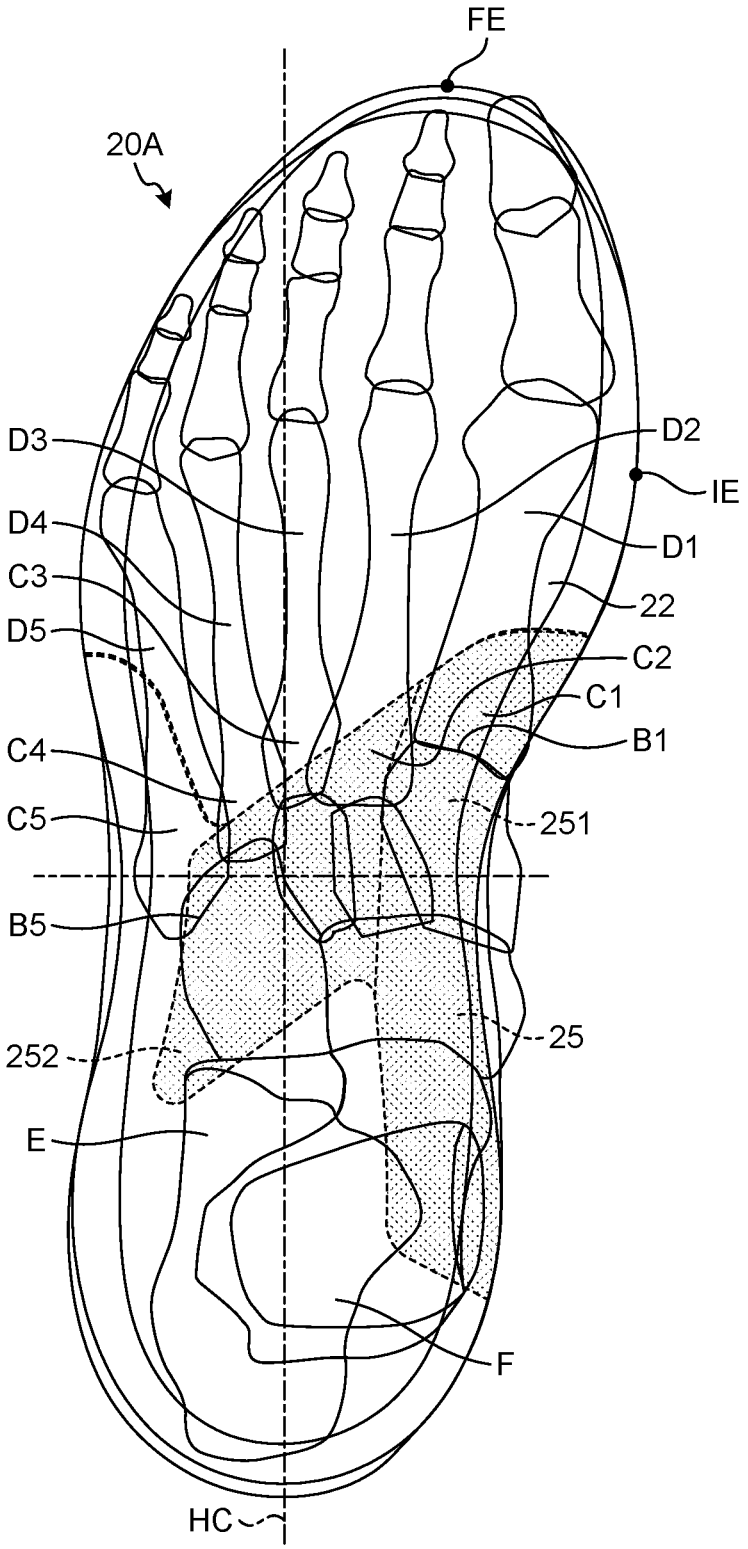
FIG. 10 is a view illustrating a positional relationship between the sole according to the first embodiment and bones of a foot of a wearer.

FIG. 2 is a side view of the sole on the lateral foot side according to the first embodiment. FIG. 3 is a top view of the sole according to the first embodiment. FIG. 4 is a side view of the sole on the medial foot side according to the first embodiment. FIGS. 5, 6, 7, and 8 are cross-sectional views of the sole according to the first embodiment. FIG. 5 illustrates a cross section taken along the line V-V in FIG. 3. FIG. 6 illustrates a cross section taken along the line VI-VI in FIG. 3. FIG. 7 illustrates a cross section taken along the line VII-VII in FIG. 3. FIG. 8 illustrates a cross section taken along the line VIII-VIII in FIG. 3. FIG. 9 is an exploded sectional view of the midsole of the sole according to the first embodiment. FIG. 10 is a view illustrating a positional relationship between the sole according to the first embodiment and bones of a foot of a wearer with a standard body shape.

As illustrated in FIG. 2, the sole 20A includes a cushion material portion 23 in addition to the above-described outsole 21 and midsole 22. The outsole 21 has an upper surface 21*a* and a ground contact surface 21*b* in contact with the ground and constitutes a lower portion of the sole 20A. The midsole 22 has an upper surface 22*a* and a lower surface 22*b* and constitutes an upper portion of the sole 20A. The cushion material portion 23 is formed of a non-foam or foam material of polymer composition and reduces the impact of landing during running. Examples of polymers included in the composition of the cushion material portion 23 include, in addition to styrene polymers such as styrene elastomer and styrene resin, olefinic polymers, ester polymers, urethane polymers, and acrylic polymers, but are not limited thereto. The cushion material portion 23 is embedded in a lateral-foot-side portion of the midsole 22 and is sandwiched from above and below by the midsole 22 in the height direction.

The outsole 21 preferably has excellent abrasion resistance and gripping property. From the viewpoint of abrasion resistance and gripping property, a member formed of a material containing a rubber material as a main component and secondary components is used for the outsole 21. Examples of the secondary components include a plasticizer, a reinforcing agent, and a crosslinking agent. The material of the outsole 21 is not limited to the exemplified materials.

The outsole 21 is generally formed of a hard member having a larger Young's modulus than the midsole 22. The ground contact surface 21*b* of the outsole 21 is provided with a tread pattern by forming unevenness in order to improve gripping property. The shape and tread pattern of the outsole 21 are appropriately designed according to the purpose of the shoe 1A.

The sole 20A includes a forefoot support portion R1 supporting the forefoot of a foot of a wearer with a standard body shape, a midfoot support portion R2 supporting the midfoot of a foot of a wearer with a standard body shape, and a rearfoot support portion R3 supporting the rearfoot of a foot of a wearer with a standard body shape. The forefoot support portion R1, the midfoot support portion R2, and the rearfoot support portion R3 are connected in this order from the front side of the sole 20A in the front-rear direction. As illustrated in FIG. 3, the forefoot support portion R1 is positioned in front of the first boundary line S1. The midfoot support portion R2 is positioned between the first boundary line S1 and the second boundary line S2. The rearfoot support portion R3 is positioned behind the second boundary line S2.

As illustrated in FIGS. 3 to 8, a side-surface reinforcement portion 21*f* formed by turning up the outsole 21 on the median side is formed only in the midfoot support portion R2 and a part of the rearfoot support portion R3 close to the front side, and the side-surface reinforcement portion 21*f* is not formed in the forefoot support portion R1 and a part of the rearfoot support portion R3 close to the rear side.

The midsole 22 is generally formed of a soft member having a smaller Young's modulus than the outsole 21.

The upper surface 22*a* of the midsole 22 has a shape in which the peripheral edge portion is raised as compared with the central portion, which provides a recessed portion on the upper surface 22*a*. The recessed portion is for receiving the upper 10 and the inner sole, and a part of the upper surface 22*a* that is a bottom surface of the recessed portion has a smooth curved surface shape so as to fit the shape of the sole of a foot. In the peripheral edge portion of the upper surface 22*a* on the medial foot side, an inclination is provided from the medial-foot-side edge to an intermediate position between a heel center axis HC and the medial-foot-side edge. The inclination of the upper surface 22*a* on the medial foot side increases toward the peripheral edge portion. Note that the upper surface 22*a* of the midsole 22 may not have the inclination in the peripheral edge portion on the medial foot side.

As illustrated in FIG. 9, the midsole 22 includes a first layer 221 and a second layer 222. The first layer 221 includes a cushioning portion 24 formed of a first foam material and a torsion control portion 25 formed of a second foam material having higher hardness than the first foam material. The second layer 222 is formed of a material having lower hardness than the torsion control portion 25. The first layer 221 is integrally formed by bonding the cushioning portion 24 and the torsion control portion 25 together. As illustrated in FIGS. 5 to 8, in the forefoot support portion R1, the midsole 22 is constituted only by the second layer 222 throughout the entire height direction. On the other hand, the first layer 221 is provided in the midfoot support portion R2 and the rearfoot support portion R3. The second layer 222 is disposed above the first layer 221. That is, in the midfoot support portion R2 and the rearfoot support portion R3, the midsole 22 has a laminated structure in which the first layer 221 and the second layer 222 are overlapped. As illustrated in FIG. 8, the above-described cushion material portion 23 is embedded in the rearfoot support portion R3 of the midsole 22 by being sandwiched between the first layer 221 and the second layer 222.

The midsole 22 is required to have excellent cushioning property while having appropriate strength. In order to achieve both appropriate strength and cushioning performance, a resin foam material containing a resin material as a main component, and a foaming agent and a crosslinking agent as secondary components is used for the cushioning portion 24 of the midsole 22. For the cushioning portion 24 of the midsole 22, a rubber foam material containing a rubber material as a main component and a plasticizer, a foaming agent, a reinforcing agent, and a crosslinking agent as secondary components may be used.

Examples of the resin material include foams of polyolefin resin, an ethylene-vinyl acetate (EVA) copolymer, and thermoplastic-polyamide-elastomer. An example of the thermosetting resin includes polyurethane. An example of the rubber material includes butadiene rubber.

In general, a foam material with low compressive stiffness easily deforms because of its low hardness, and a foam material with high compressive stiffness is difficult to deform because of its high hardness. In the sole 20A according to first embodiment, the cushioning portion 24 formed of the first foam material in the midsole 22 greatly deforms by receiving the load and serves to absorb the impact of landing. On the other hand, the torsion control portion 25 formed of the second foam material in the midsole 22 less deforms than the cushioning portion 24, and serves to secure stability during landing.

As illustrated in FIG. 3, the torsion control portion 25 includes a first portion 251 extending in the front-rear direction on the medial foot side and a second portion 252 extending obliquely rearward from the first portion 251 toward the lateral foot side. The first portion 251 serves as a medial-foot-side surface of the torsion control portion 25. Therefore, as illustrated in FIG. 6, in the midfoot support portion R2 and a part of the rearfoot support portion R3 closer to the front side, the first portion 251 of the torsion control portion 25 is covered from the medial foot side by the side-surface reinforcement portion 21*f*.

The first portion 251 is disposed over the entire midfoot support portion R2 and a part of the rearfoot support portion R3 closer to the front side. The first portion 251 is disposed from the medial-foot-side edge of the sole 20A with a width supporting at least a first metatarsal base C1 of a wearer. For example, the first portion 251 is disposed from a position on the medial-foot-side edge of the sole 20A and corresponding to 40% of the dimension in the front-rear direction of the sole 20A from a front end FE of the sole 20A through to a position on the medial-foot-side edge of the sole 20A and corresponding to 85% of the dimension in the front-rear direction of the sole 20A from the front end FE of the sole 20A. Note that the first portion 251 is only required to extend in the front-rear direction at least over the entire midfoot support portion R2 and may not extend to the rearfoot support portion R3. The first portion 251 is provided with a width of 15% to 45% of the dimension in the foot-width direction from the medial-foot-side edge. As an example, if the size of the shoe 1A is 27 cm, the dimension of the first portion 251 in the foot-width direction is 25 mm. Note that the dimension of the first portion 251 in the foot-width direction is not limited to the exemplified value. The first portion 251 supports the midfoot of the wearer from below on the medial foot side to prevent the heel of the wearer of the shoe 1A from falling inward.

As illustrated in FIG. 10, the second portion 252 extends in a direction connecting a portion supporting a first metatarsal proximal end B1 and a portion supporting a fifth metatarsal proximal end B5 of a wearer with a standard body shape, and is disposed in a region supporting a second metatarsal base C2, a third metatarsal base C3, a fourth metatarsal base C4, and a fifth metatarsal base C5. Note that the portion supporting the first metatarsal proximal end B1 of a wearer with a standard body shape is at a position corresponding to 48% of the dimension in the front-rear direction from the front end FE of the sole 20A and 12% of the dimension in the foot-width direction from a medial-foot-side end IE of the sole 20A. In addition, the portion supporting the fifth metatarsal proximal end B5 of a wearer with a standard body shape is at a position corresponding to 60% of the dimension in the front-rear direction from the front end FE of the sole 20A and 80% of the dimension in the foot-width direction from the medial-foot-side end IE of the sole 20A. The second portion 252 is provided in a region corresponding to a range surrounded by a line connecting a first position, a second position, a third position, and a fourth position. The first position corresponds to 54% of the dimension in the front-rear direction from the front end FE of the sole 20A and 80% of the dimension in the foot-width direction from the medial-foot-side end IE of the sole 20A. The second position corresponds to 40% of the dimension in the front-rear direction from the front end FE of the sole 20A and 32% of the dimension in the foot-width direction from the medial-foot-side end IE of the sole 20A. The third position corresponds to 60% of the dimension in the front-rear direction from the front end FE of the sole 20A and 30% of the dimension in the foot-width direction from the medial-foot-side end IE of the sole 20A. The fourth position corresponds to 72% of the dimension in the front-rear direction from the front end FE of the sole 20A and 75% of the dimension in the foot-width direction from the medial-foot-side end IE of the sole 20A. As an example, if the size of the shoe 1A is 27 cm, the dimension of the second portion 252 in the front-rear direction is about 53 mm, which can support the second metatarsal base C2, the third metatarsal base C3, the fourth metatarsal base C4, and the fifth metatarsal base C5 of a wearer with a standard body shape. The second portion 252 supports the second metatarsal base C2 to the fifth metatarsal base C5 of the wearer of the shoe 1A from below, thereby controlling torsion of the shoe 1A during running.

Note that the second portion 252 is only required to be disposed in a region supporting at least the second metatarsal base C2 to the fourth metatarsal base C4 of a wearer with a standard body shape and may not be disposed in a region supporting the fifth metatarsal base C5. The second portion 252 may be provided in a range narrower than the above range in the front-rear direction.

As illustrated in FIG. 4, the medial-foot-side surface of the torsion control portion 25 is formed with a plurality of rib-shaped protrusions 26. Each of the plurality of rib-shaped protrusions 26 extends from the upper rear side toward the lower front side. The plurality of rib-shaped protrusions 26 serves to increase stiffness of the torsion control portion 25. Therefore, by providing the plurality of rib-shaped protrusions 26, the stiffness of the torsion control portion 25 can be increased without increasing the hardness of the second foam material itself. By setting the extending direction of the plurality of rib-shaped protrusions 26 from the upper rear side toward the lower front side, the effect in enhancing the stiffness of the torsion control portion 25 can be increased. However, as long as the plurality of rib-shaped protrusions 26 is provided, the effect in enhancing the stiffness of the torsion control portion 25 can be obtained regardless of the extending direction of the plurality of rib-shaped protrusions 26. That is, the direction in which the plurality of rib-shaped protrusions 26 extends is not limited to the direction from the upper rear side to the lower front side. Note that the medial-foot-side surface of the torsion control portion 25 may not be formed with the plurality of rib-shaped protrusions 26

The second layer 222 is formed of a material having lower hardness than the torsion control portion 25 and serves to absorb the impact of landing. Since the sole has the second layer 222, the impact of landing can be absorbed even at the portion where the torsion control portion 25 is disposed, and the load applied to the foot of the wearer can be reduced.

Since the torsion control portion 25 has the first portion 251, the shoe 1A including the sole 20A can control overpronation in which the heel of the wearer falls inward more than necessary during running. That is, when a person who is prone to overpronation wears the shoe 1A, the sole of the foot can be stably supported by the first portion 251 on the medial foot side. In addition, since the first portion 251 is disposed over the entire midfoot support portion R2 and a part of the rearfoot support portion R3 closer to the front side, the midsole 22 can deform following plantarflexion of the foot in the push-off phase. Furthermore, the second portion 252 controls excessive deformation of the midsole 22, which can prevent the effect in controlling overpronation from lowering due to torsion of the shoe 1A during running. Therefore, the shoe 1A including the sole 20A can stably support the sole of the foot of the wearer on the medial foot side without bad footwork.

In a portion of the midsole 22 where the first layer 221 and the second layer 222 overlap each other, the ratio of the thickness of the first layer 221 to the thickness of the second layer 222 is arbitrary. That is, the first layer 221 and the second layer 222 may have the same thickness, the first layer 221 may be thicker than the second layer 222, or the first layer 221 may be thinner than the second layer 222. If the thickness of the midsole 22 is constant, the torsion control portion 25 becomes thicker as the first layer 221 becomes thicker, and the effect in controlling overpronation and torsion is enhanced. On the other hand, the cushioning performance is enhanced as the second layer 222 becomes thicker.

When the sole 20A deforms due to torsion of the shoe 1A, a compressive force is applied to the upper surface 22*a* of the midsole 22, and a tensile force is applied to the lower surface 22*b*. The torsion control portion 25 formed of the second foam material is easily crushed by the compressive force because of its porosity, but has high stiffness against the tensile force. Therefore, by disposing the second layer 222 on the first layer 221 in the midfoot support portion R2 and the rearfoot support portion R3, a tensile force can be applied to the entire torsion control portion 25 when the sole 20A deforms due to torsion of the shoe 1A, thereby enhancing the effect of the second portion 252 in controlling the torsion.

Since a part of the medial-foot-side wall surface of the torsion control portion 25 is covered with the side-surface reinforcement portion 21*f*, the stiffness of the torsion control portion 25 is increased, and the degree of torsion control is enhanced. Note that, when another member is disposed between the midsole 22 and the upper 10, the torsion control effect can be enhanced even if a part of the medial-foot-side wall surface of the torsion control portion 25 is covered with the member. In addition, when another member is disposed between the midsole 22 and the outsole 21, the torsion control effect can be enhanced even if a part of the medial-foot-side wall surface of the torsion control portion 25 is covered with the member.

As described above, the sole 20A according to the first embodiment and the shoe 1A including the same can adjust the falling degree of the heel of a foot and can deform following plantarflexion of the foot.

In the midsole 22, the hardness of the cushioning portion 24 is preferably 20 degrees or more and 70 degrees or less on the type-E durometer hardness measured with a type E durometer defined in JIS K 6253-3, and more preferably 40 degrees or more and 60 degrees or less. On the other hand, the hardness of the torsion control portion 25 is preferably 50 degrees or more and 85 degrees or less on the condition that the type-E durometer hardness is higher than the type-E durometer hardness of the cushioning portion 24. The difference between the type-E durometer hardness of the torsion control portion 25 and the type-E durometer hardness of the cushioning portion 24 is preferably 8 degrees or more, and more preferably 10 degrees or more.

In addition, the sole 20A according to first embodiment includes the first layer 221 in which the cushioning portion 24 and the torsion control portion 25 are bonded and integrated as described above. Such a configuration can be manufactured by overlapping a foam material to be the cushioning portion 24 and a foam material to be the torsion control portion 25 and welding them by press-molding. Therefore, by using the press-molding manufacturing method, the sole 20A including the first layer 221 having the cushioning portion 24 and the torsion control portion 25 can be easily and inexpensively manufactured. Note that the foam material to be the cushioning portion 24 and the foam material to be the torsion control portion 25 may be simultaneously injection-foamed and molded and then disposed in the same mold to be press-molded, or the foam material to be the cushioning portion 24 and the foam material to be the torsion control portion 25 may be separately injection-foamed and molded and then disposed in the same mold to be press-molded. When the foam material to be the cushioning portion 24 and the foam material to be the torsion control portion 25 are simultaneously injection-foamed and molded, the increase in the number of required molds and man-hours can be reduced, thereby lowering manufacturing costs and improving production efficiency. When the foam material to be the cushioning portion 24 and the foam material to be the torsion control portion 25 are separately injection-foamed and molded, the boundary between the cushioning portion 24 and the torsion control portion 25 is clear, thereby reliably disposing the torsion control portion 25 at a desired position.

However, the sole 20A is not required to be manufactured by the above-described manufacturing method, and the sole 20A may be manufactured by, for example, bonding a foam material to be the cushioning portion 24 and a foam material to be the torsion control portion 25 by adhesion or the like via an adhesive layer to form the first layer 221.

At least a part of the torsion control portion 25 may be formed of a non-foamed material having low hardness. For example, only the first portion 251 of the torsion control portion 25 may be formed of a non-foamed material having low hardness. Alternatively, only the second portion 252 of the torsion control portion 25 may be formed of a non-foamed material having low hardness. The low-hardness non-foamed material is preferably 70 degrees or less on the type-A durometer hardness measured with a type A durometer defined in JIS K 6253-3. Examples of the low-hardness non-foamed material include a sheet of EVA, low-hardness thermosetting polyurethane, and rubber, but are not limited to these materials. Forming at least a part of the torsion control portion 25 with a non-foamed material can increase the effect in controlling pronation and torsion compared with forming the entire torsion control portion 25 with a foam material. When a sheet of EVA or low-hardness thermosetting polyurethane is used as a material of at least a part of the torsion control portion the foam material and the non-foamed material can be integrated into a single part by disposing these parts in a mold for forming the foam material and press-forming them together with the foam material, thereby reducing the increase in man-hours in the manufacturing process of the shoe 1A due to the increase in the number of parts.

First Modification

Figure 11:
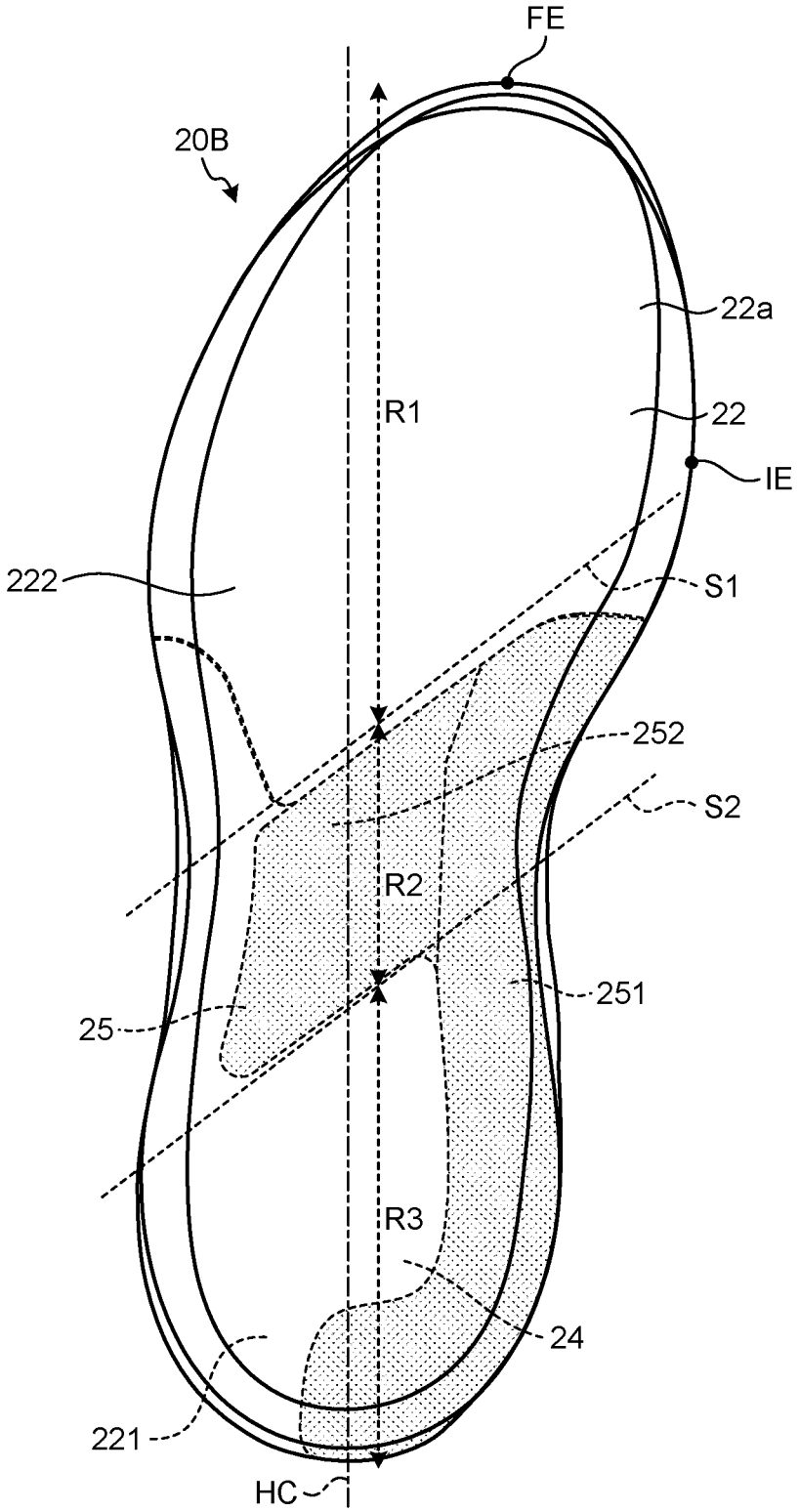
FIG. 11 is a top view of a sole according to a first modification of the first embodiment.

FIG. 11 is a top view of a sole according to a first modification of the first embodiment. A sole 20B according to the first modification is different from the sole 20A according to the first embodiment in that the first portion 251 of the torsion control portion 25 extends to the rear side of a calcaneus E of a wearer with a standard body shape illustrated in FIG. 10. The first portion 251 extends to the rear side of the calcaneus E in such a manner as to go around while avoiding immediately below the center of the calcaneus E, and reaches the rear end of the rearfoot support portion R3. Note that the portion immediately below the center of the calcaneus E is at a position corresponding to 85% of the dimension in the front-rear direction from the front end FE of the sole 20B and 50% of the dimension in the foot-width direction from the medial-foot-side end IE of the sole 20B. The sole 20B according to the first modification is used instead of the sole 20A according to the first embodiment to constitute the shoe 1A.

Since the first portion 251 extends to the rear side of the calcaneus E of a wearer with a standard body shape, the shoe 1A configured using the sole 20B has higher effect in controlling overpronation in the heel landing phase than the shoe 1A configured using the sole 20A.

Since the first portion 251 is not disposed immediately below the center of the calcaneus E, the sole 20B can prevent the impact from being directly transmitted to the foot of the wearer in the heel landing phase.

Second Modification

Figure 12:
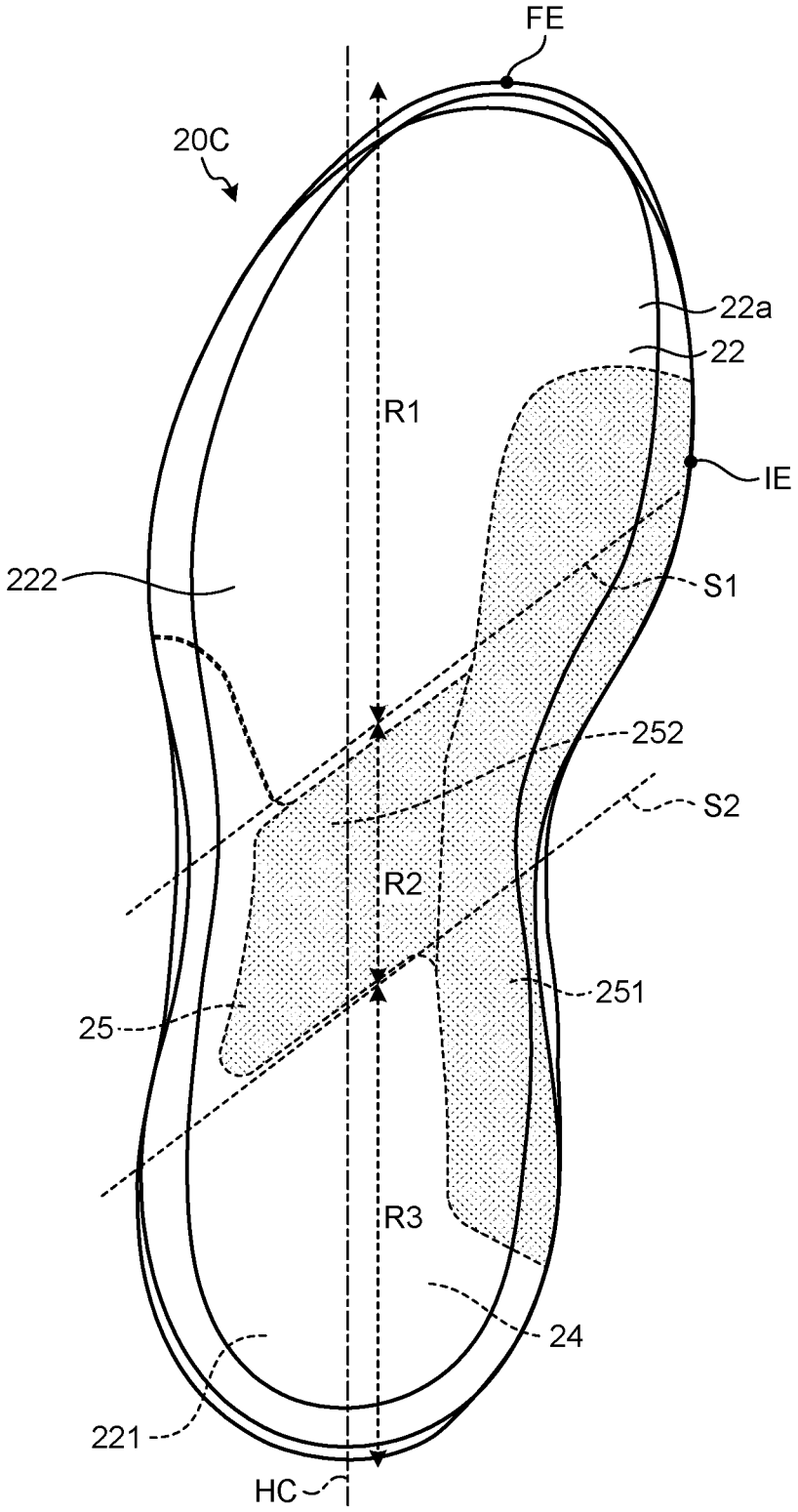
FIG. 12 is a top view of a sole according to a second modification of the first embodiment.

FIG. 12 is a top view of a sole according to a second modification of the first embodiment. A sole 20C according to the second modification is different from the sole 20A according to the first embodiment in that the first portion 251 of the torsion control portion 25 extends forward to a range supporting a first metatarsal shaft D1 of a wearer with a standard body shape illustrated in FIG. 10. Note that the portion supporting the first metatarsal shaft D1 of a wearer with a standard body shape is at a position corresponding to 20% of the dimension in the front-rear direction from the front end FE of the sole 20C and 30% of the dimension in the foot-width direction from the medial-foot-side end IE of the sole 20C. The second portion 252 of the torsion control portion 25 is provided in the same portion as the sole 20A according to the first embodiment. Therefore, in the torsion control portion 25 of the sole 20C according to the second modification, the second portion 252 extends obliquely rearward from the intermediate portion of the first portion 251. The sole 20C according to the second modification is used instead of the sole 20A according to the first embodiment to constitute the shoe 1A.

In the shoe 1A configured using the sole 20C, since the first portion 251 extends to a range supporting the first metatarsal shaft D1 of a wearer with a standard body shape, the effect in controlling overpronation in the push-off phase is higher than that of the shoe 1A configured using the sole 20A.

Third Modification

Figure 13:
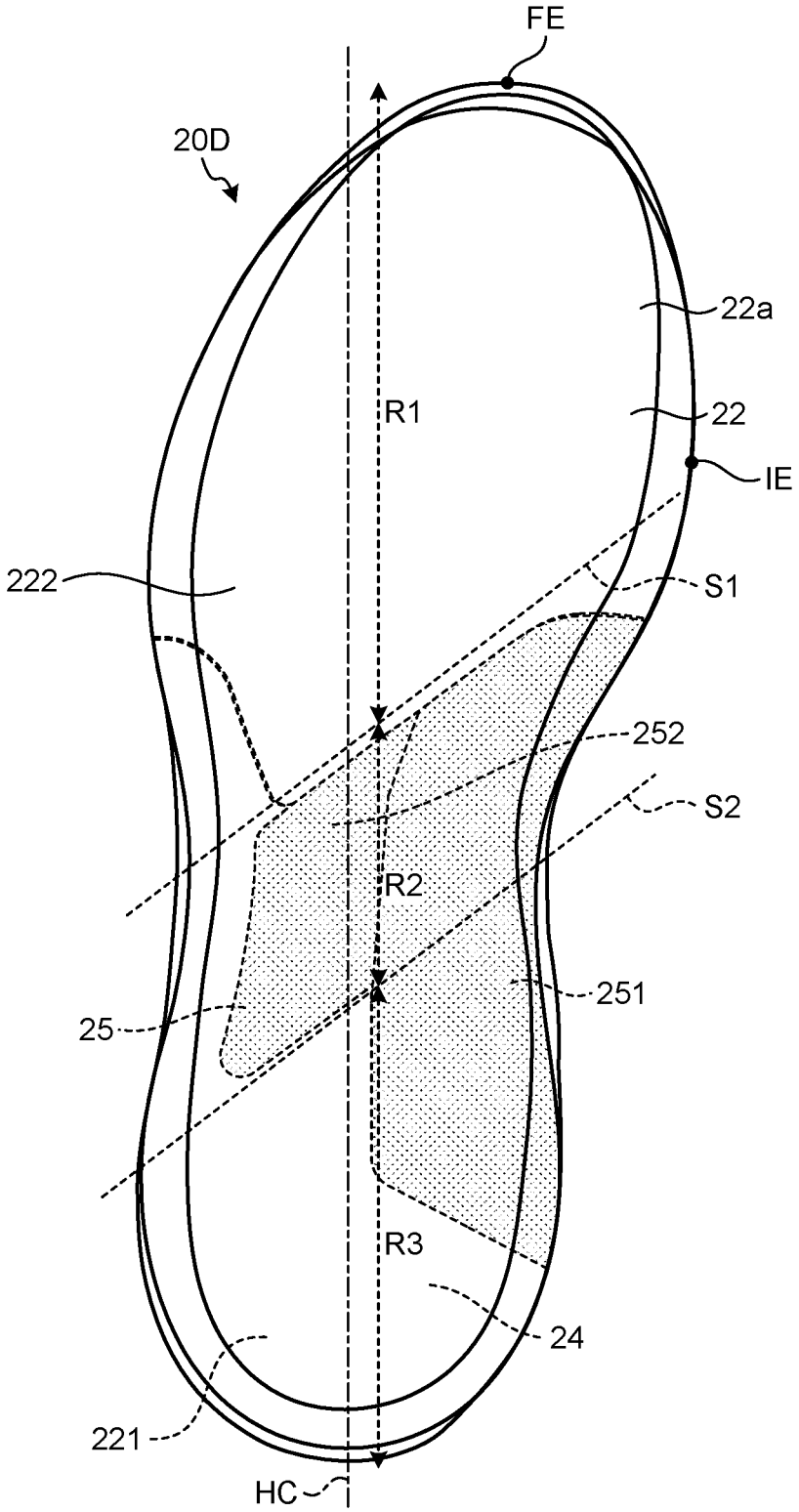
FIG. 13 is a top view of a sole according to a third modification of the first embodiment.

FIG. 13 is a top view of a sole according to a third modification of the first embodiment. A sole 20D according to the third modification is different from the sole 20A according to the first embodiment in that the width of the first portion 251 of the torsion control portion 25 is widened. The widened first portion 251 supports the second metatarsal base C2 in addition to the first metatarsal base C1 of a foot of a wearer with a standard body shape illustrated in FIG. 10. For example, the first portion 251 is provided with a width of 15% to 45% of the dimension in the foot-width direction from the medial-foot-side edge of the sole 20D. The sole 20D according to the third modification is used instead of the sole 20A according to the first embodiment to constitute the shoe 1A.

Since the first portion 251 supports the second metatarsal base C2, the shoe 1A configured using the sole 20D has higher effect in controlling overpronation than the shoe 1A configured using the sole 20A. Therefore, when a person with a strong degree of overpronation runs, the load applied to the foot of the wearer can be further reduced by wearing the shoe 1A configured using the sole 20D.

Fourth Modification

Figure 14:
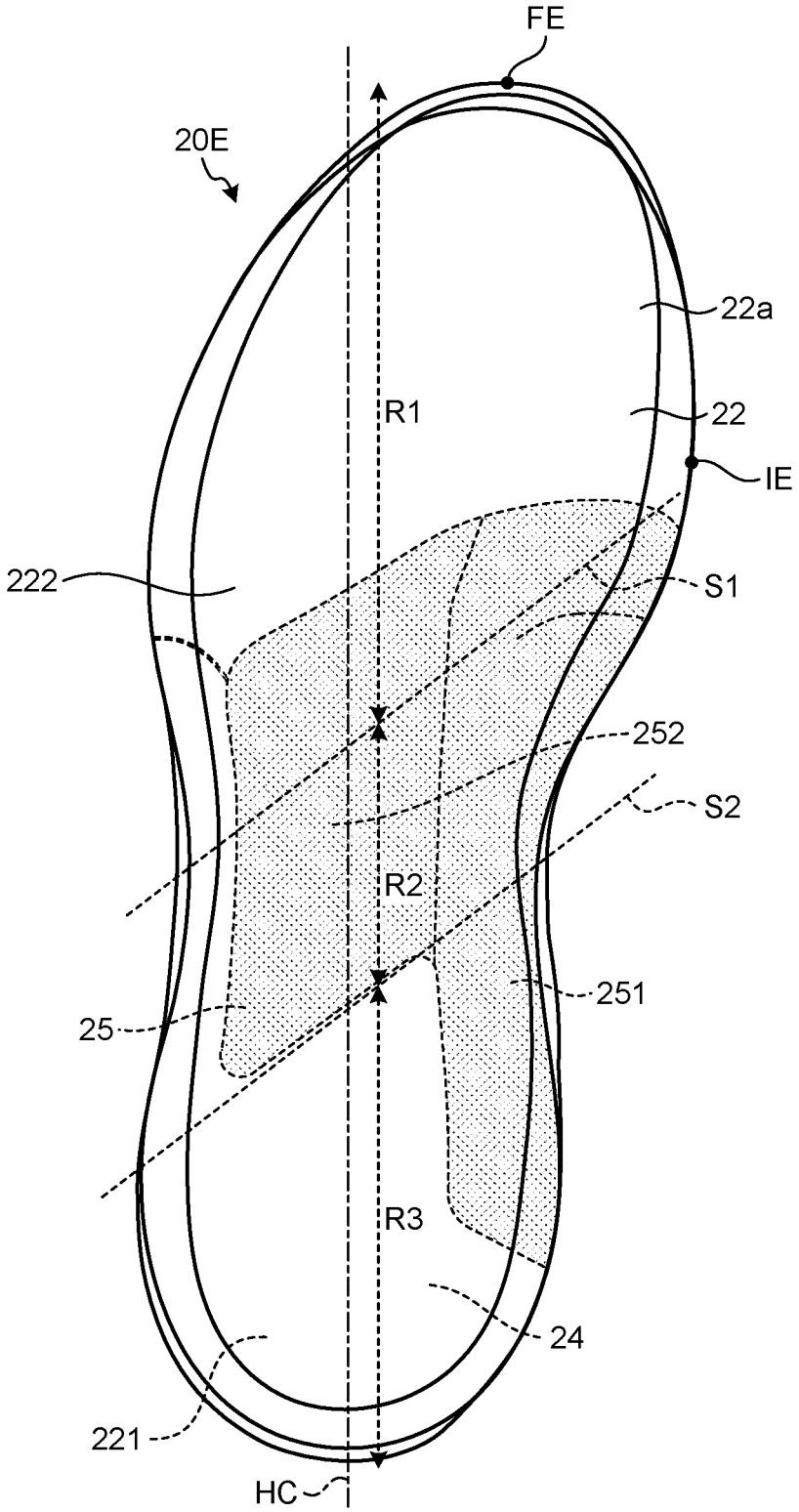
FIG. 14 is a top view of a sole according to a fourth modification of the first embodiment.

FIG. 14 is a top view of a sole according to a fourth modification of the first embodiment. A sole 20E according to the fourth modification is different from the sole 20A according to the first embodiment in that the first portion 251 of the torsion control portion 25 extends forward to a range supporting the first metatarsal shaft D1 of the foot of a wearer with a standard body shape illustrated in FIG. 10 and that the second portion 252 is expanded to a range supporting a second metatarsal shaft D2, a third metatarsal shaft D3, a fourth metatarsal shaft D4, and a fifth metatarsal shaft D5. Note that the portion supporting the second metatarsal shaft D2 of a wearer with a standard body shape is at a position corresponding to 32% of the dimension in the front-rear direction from the front end FE of the sole 20E and 41% of the dimension in the foot-width direction from the medial-foot-side end IE of the sole 20E. In addition, the portion supporting the third metatarsal shaft D3 of a wearer with a standard body shape is at a position corresponding to 35% of the dimension in the front-rear direction from the front end FE of the sole 20E and 57% of the dimension in the foot-width direction from the medial-foot-side end IE of the sole 20E. In addition, the portion supporting the fourth metatarsal shaft D4 of a wearer with a standard body shape is at a position corresponding to 37% of the dimension in the front-rear direction from the front end FE of the sole 20E and 70% of the dimension in the foot-width direction from the medial-foot-side end IE of the sole 20E. In addition, the portion supporting the fifth metatarsal shaft D5 of a wearer with a standard body shape is at a position corresponding to 39% of the dimension in the front-rear direction from the front end FE of the sole 20E and 83% of the dimension in the foot-width direction from the medial-foot-side end IE of the sole 20E. In the sole 20E, the front edge of the second portion 252 is positioned in a portion supporting the second metatarsal shaft D2 of a wearer with a standard body shape illustrated in FIG. 10. For example, the first portion 251 is disposed from a position corresponding to 32% of the dimension in the front-rear direction of the sole 20E from the front end FE of the sole 20E to a position corresponding to 69%. In addition, the first portion 251 is provided with a width of 15% to 45% of the dimension in the foot-width direction from the medial-foot-side edge. In addition, the second portion 252 is provided in a region corresponding to a range surrounded by a line connecting a first position, a second position, a third position, and a fourth position. The first position corresponds to 41% of the dimension in the front-rear direction from the front end FE of the sole 20E and 83% of the dimension in the foot-width direction from the medial-foot-side end IE of the sole 20E. The second position corresponds to 31% of the dimension in the front-rear direction from the front end FE of the sole 20E and 32% of the dimension in the foot-width direction from the medial-foot-side end IE of the sole 20E. The third position corresponds to 60% of the dimension in the front-rear direction from the front end FE of the sole 20E and 30% of the dimension in the foot-width direction from the medial-foot-side end IE of the sole 20E. The fourth position corresponds to 72% of the dimension in the front-rear direction from the front end FE of the sole 20E and 75% of the dimension in the foot-width direction from the medial-foot-side end IE of the sole 20E. In the sole 20E according to the fourth modification, the second portion 252 extends obliquely rearward from the front end of the first portion 251. The sole 20E according to the fourth modification is used instead of the sole 20A according to the first embodiment to constitute the shoe 1A.

Since the first portion 251 of the torsion control portion 25 extends forward to a range supporting the first metatarsal shaft D1, and the second portion 252 is expanded to a range supporting the second metatarsal shaft D2, the third metatarsal shaft D3, the fourth metatarsal shaft D4, and the fifth metatarsal shaft D5, the shoe 1A configured using the sole 20E has higher torsional stiffness of the midfoot support portion R2 than the shoe 1A configured using the sole 20A. Therefore, it is possible to prevent the effect in controlling overpronation from lowering due to torsion of the shoe 1A during running.

Fifth Modification

Figure 15:
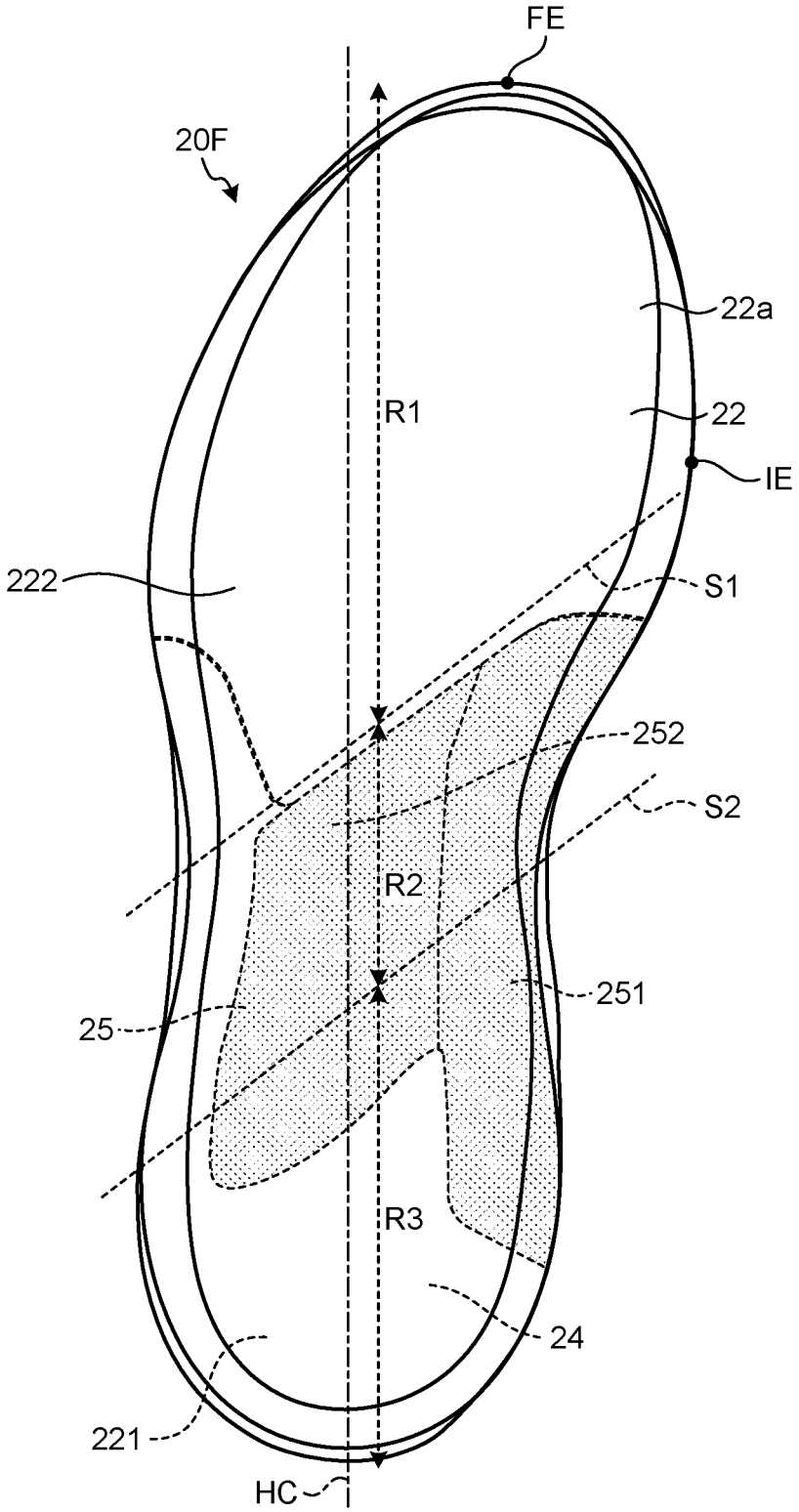
FIG. 15 is a top view of a sole according to a fifth modification of the first embodiment.

FIG. 15 is a top view of a sole according to a fifth modification of the first embodiment. A sole 20F according to the fifth modification is different from the sole 20A according to the first embodiment in that the rear edge of the second portion 252 is widened so as to be positioned in a portion supporting the calcaneus E of a wearer on the heel center axis HC and that the second portion 252 supports a part of the front side of the calcaneus E. For example, the rear edge of the second portion 252 on the heel center axis HC is positioned at the anterior end part of a talus F of a wearer with a standard body shape illustrated in FIG. 10. The position of the anterior end part of the talus F on the heel center axis HC is a position corresponding to 75% of the dimension in the front-rear direction of the sole 20F from the heel center. In addition, the second portion 252 is provided in a region corresponding to a range surrounded by a line connecting a first position, a second position, a third position, and a fourth position. The first position corresponds to 54% of the dimension in the front-rear direction from the front end FE of the sole 20F and 80% of the dimension in the foot-width direction from the medial-foot-side end IE of the sole 20F. The second position corresponds to 40% of the dimension in the front-rear direction from the front end FE of the sole 20F and 32% of the dimension in the foot-width direction from the medial-foot-side end IE of the sole 20F. The third position corresponds to 70% of the dimension in the front-rear direction from the front end FE of the sole 20F and 30% of the dimension in the foot-width direction from the medial-foot-side end IE of the sole 20F. The fourth position corresponds to 84% of the dimension in the front-rear direction from the front end FE of the sole 20F and 80% of the dimension in the foot-width direction from the medial-foot-side end IE of the sole 20F. The sole 20F according to the fifth modification is used instead of the sole 20A according to the first embodiment to constitute the shoe 1A.

Since the second portion 252 is widened in order for the second portion 252 to support a part of the front side of the calcaneus E, the shoe 1A configured using the sole 20F has higher torsional stiffness of the midfoot support portion R2 than the shoe 1A configured using the sole 20A. Therefore, it is possible to prevent the effect in controlling overpronation from lowering due to torsion of the shoe 1A during running. Note that since the second portion 252 is not disposed immediately below the center of the talus F, the impact is not directly transmitted to the foot of a wearer of the shoe 1A configured using the sole 20F in the heel landing phase.

Sixth Modification

Figure 16:
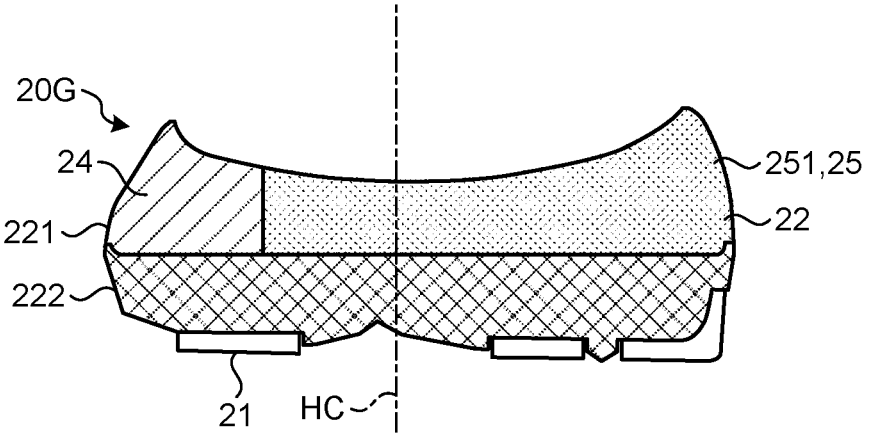
FIG. 16 is a cross-sectional view of a sole according to a sixth modification of the first embodiment.
Figure 17:
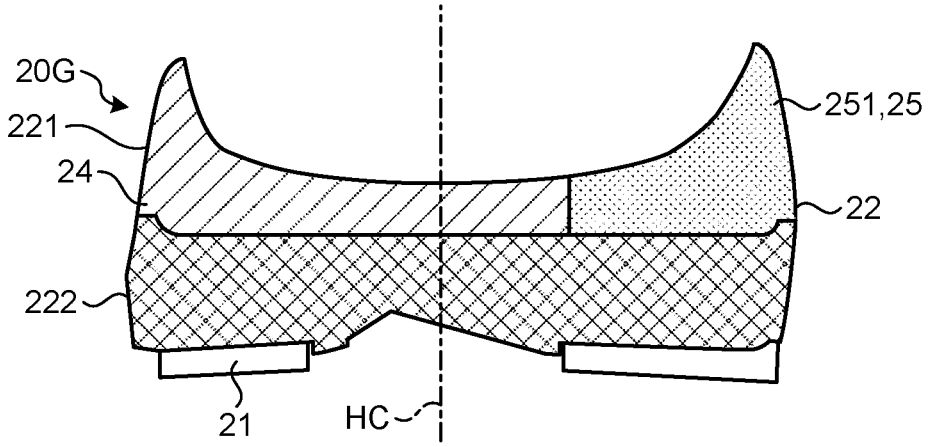
FIG. 17 is a cross-sectional view of the sole according to the sixth modification of the first embodiment.

FIGS. 16 and 17 are cross-sectional views of a sole according to a sixth modification of the first embodiment. The cross section of a sole 20G according to the sixth modification illustrated in FIG. 16 is a cross section at a position corresponding to the position indicated by the line VI-VI of the sole 20A according to the first embodiment. In addition, the cross section of the sole 20G according to the sixth modification illustrated in FIG. 17 is a cross section at a position corresponding to the position indicated by the line VII-VII of the sole 20A according to the first embodiment. The sole 20G according to the sixth modification is different from the sole 20A according to the first embodiment in that the second layer 222 is disposed below the first layer 221 in the midfoot support portion R2 and the rearfoot support portion R3. That is, in the sole 20 G according to the sixth modification, the disposition of the first layer 221 and the second layer 222 in the midfoot support portion R2 and the rearfoot support portion R3 is opposite to that in the sole 20A according to the first embodiment. The sole 20G according to the sixth modification is used instead of the sole 20A according to the first embodiment to constitute the shoe 1A.

In the heel landing phase, the sole 20G warps and deforms to be recessed downward. Therefore, in the sole 20G in which the first layer 221 is disposed on the upper side of the second layer 222, a compressive force is applied to the torsion control portion 25 formed of the second foam material. As described above, the torsion control portion 25 formed of the second foam material has high stiffness against a tensile force because of its porosity, but is easily crushed by the compressive force. Therefore, in the sole 20G according to the sixth modification, the torsion control portion 25 can have a function of absorbing the impact in the heel landing phase, and the impact absorption performance can be enhanced as compared with the sole 20A according to the first embodiment.

Note that the sole 20G according to the sixth modification has a structure in which the first layer 221 is disposed on the upper side of the second layer 222, and the torsion control portion 25 easily deforms. Thus, it is preferable to increase the hardness of the second foam material compared with the sole 20A according to the first embodiment.

In FIGS. 16 and 17, the interface between the first layer 221 and the second layer 222 is a flat surface, but may be a curved surface similar to the upper surface 22*a* of the midsole 22.

Seventh Modification

Figure 18:
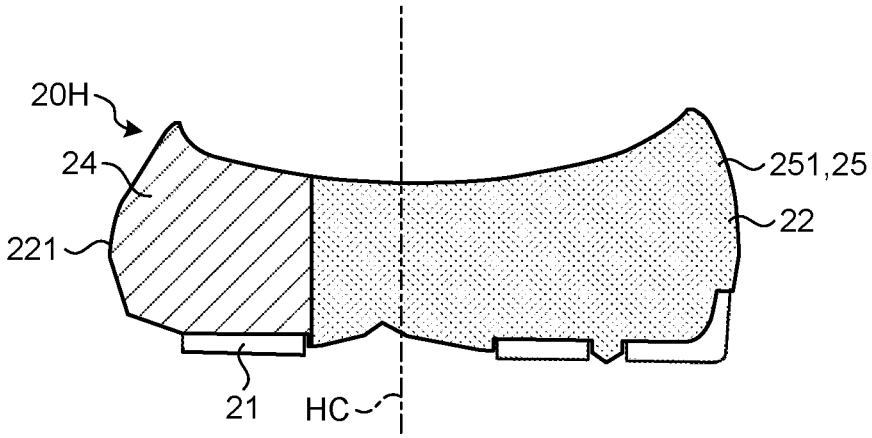
FIG. 18 is a cross-sectional view of a sole according to a seventh modification of the first embodiment.
Figure 19:
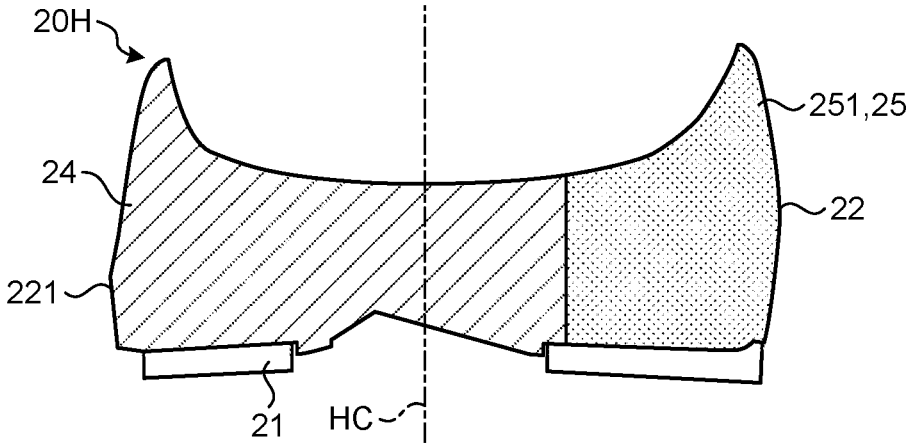
FIG. 19 is a cross-sectional view of the sole according to the seventh modification of the first embodiment.

FIGS. 18 and 19 are cross-sectional views of a sole according to a seventh modification of the first embodiment. The cross section of a sole 20H according to the seventh modification illustrated in FIG. 18 is a cross section at a position corresponding to the position indicated by the line VI-VI of the sole 20A according to the first embodiment. In addition, the cross section of the sole 20H according to the seventh modification illustrated in FIG. 19 is a cross section at a position corresponding to the position indicated by the line VII-VII of the sole 20A according to the first embodiment. The sole 20H according to the seventh modification is different from the sole 20A according to the first embodiment in that the entire midsole 22 is formed of the first layer 221 including the cushioning portion 24 and the torsion control portion 25. The sole 20H according to the seventh modification is used instead of the sole 20A according to the first embodiment to constitute the shoe 1A.

Since the entire midsole 22 is formed of the first layer 221, the shoe 1A configured using the sole 20H has fewer parts than the shoe 1A using the sole 20A according to the first embodiment. Therefore, by configuring the shoe 1A using the sole 20H, the manufacturing efficiency of the shoe 1A can be improved.

Eighth Modification

Figure 20:
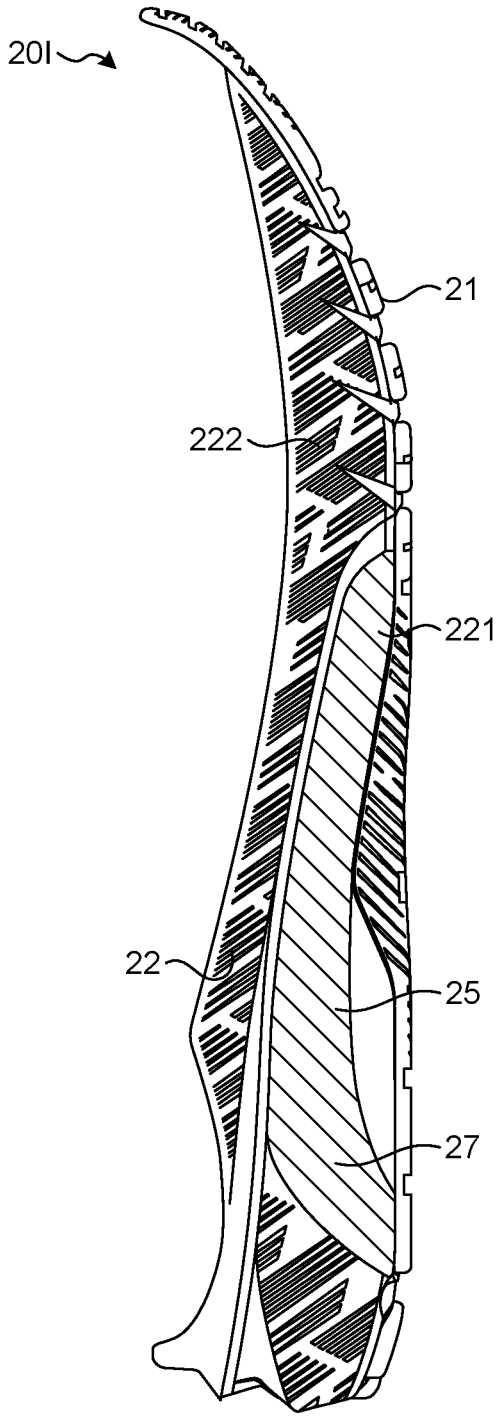
FIG. 20 is a side view of a sole on a medial foot side according to an eighth modification of the first embodiment.

FIG. 20 is a side view of a sole on a medial foot side according to an eighth modification of the first embodiment. A sole 20I according to the eighth modification is different from the sole 20A according to the first embodiment in that the medial-foot-side surface of the torsion control portion 25 is provided with groove-shaped recesses 27. The sole 20I according to the eighth modification is used instead of the sole 20A according to the first embodiment to constitute the shoe 1A.

In the shoe 1A configured using the sole 20I, a plurality of groove-shaped recesses 27 is formed on the medial-foot-side surface of the torsion control portion 25.

Each of the plurality of groove-shaped recesses 27 extends from the lower rear side toward the upper front side. The plurality of groove-shaped recesses 27 serves to reduce stiffness of the torsion control portion 25. Therefore, by providing the plurality of groove-shaped recesses 27, the stiffness of the torsion control portion 25 can be reduced without reducing the hardness of the second foam material itself. By setting the extending direction of the plurality of groove-shaped recesses 27 from the lower rear side to the upper front side, the effect in reducing the stiffness of the torsion control portion 25 can be increased. However, as long as the plurality of groove-shaped recesses 27 is provided, the effect in reducing the stiffness of the torsion control portion 25 can be obtained regardless of the extending direction of the plurality of groove-shaped recesses 27. That is, the direction in which the plurality of groove-shaped recesses 27 extends is not limited to the direction from the lower rear side to the upper front side.

Ninth Modification

Figure 21:
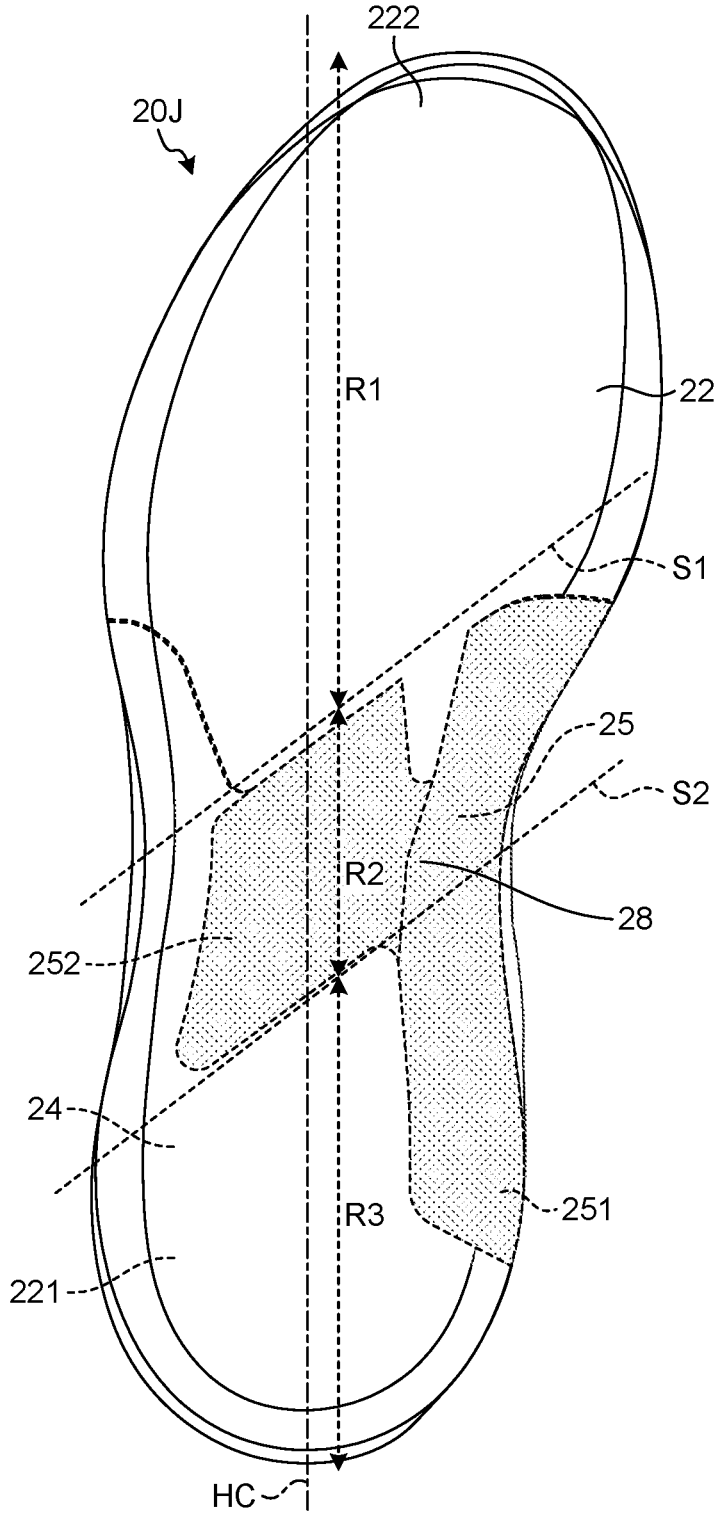
FIG. 21 is a top view of a sole according to a ninth modification of the first embodiment.

FIG. 21 is a top view of a sole according to a ninth modification of the first embodiment. A sole 20J according to the ninth modification is different from the sole 20A according to the first embodiment in that a narrowed portion 28 having a partially small dimension in the front-rear direction is formed in the second portion 252. The sole 20J according to the ninth modification is used instead of the sole 20A according to the first embodiment to constitute the shoe 1A.

Since the narrowed portion 28 is provided in the second portion 252, the sole 20J has lower stiffness of the second portion 252 than the sole 20A according to the first embodiment. That is, by providing the narrowed portion 28 in the second portion 252, the stiffness of the second portion 252 can be adjusted without changing the type of the second foam material used as the material of the torsion control portion 25.

Since the narrowed portion 28 is provided in the second portion 252 and the stiffness of the second portion 252 is low, the shoe 1A configured using the sole 20J easily deforms following plantarflexion of the foot of a wearer.

Figure 22:
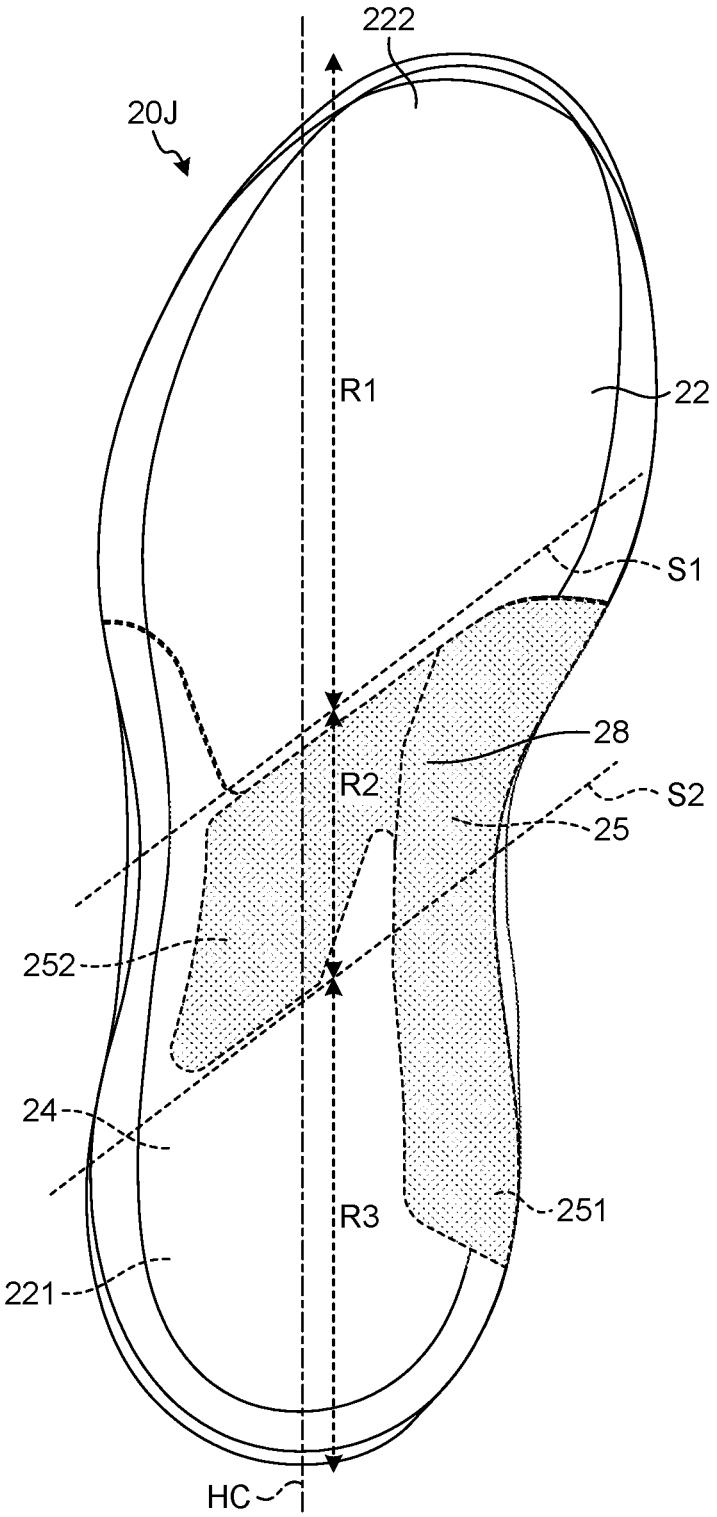
FIG. 22 is a top view of the sole according to another configuration of the ninth modification of the first embodiment.
Figure 23:
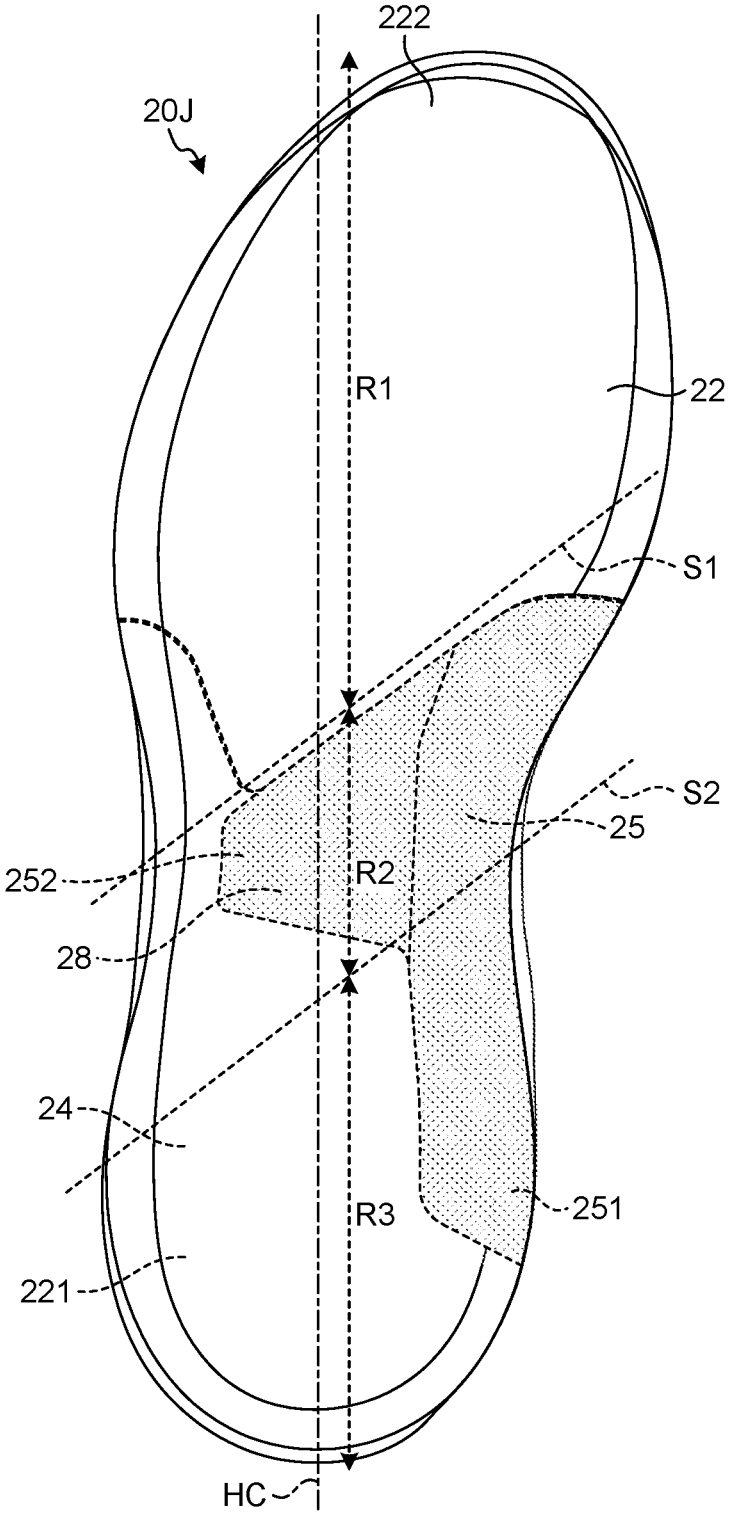
FIG. 23 is a top view of the sole according to another configuration of the ninth modification of the first embodiment.

FIGS. 22 and 23 are top views of the sole according to other configurations of the ninth modification of the first embodiment. In the sole 20J illustrated in FIG. 21, the narrowed portion 28 is provided by forming a cutout from the front side at the boundary of the second portion 252 with the first portion 251. However, the narrowed portion 28 may be provided by forming a cutout from the rear side at the boundary of the second portion 252 with the first portion 251, as illustrated in FIG. 22. Alternatively, the narrowed portion 28 may be provided in a portion of the second portion 252 on the lateral foot side, as illustrated in FIG. 23.

Note that the portion where the second portion 252 is cut out is preferably covered with the outsole 21.

Second Embodiment

Figure 24:
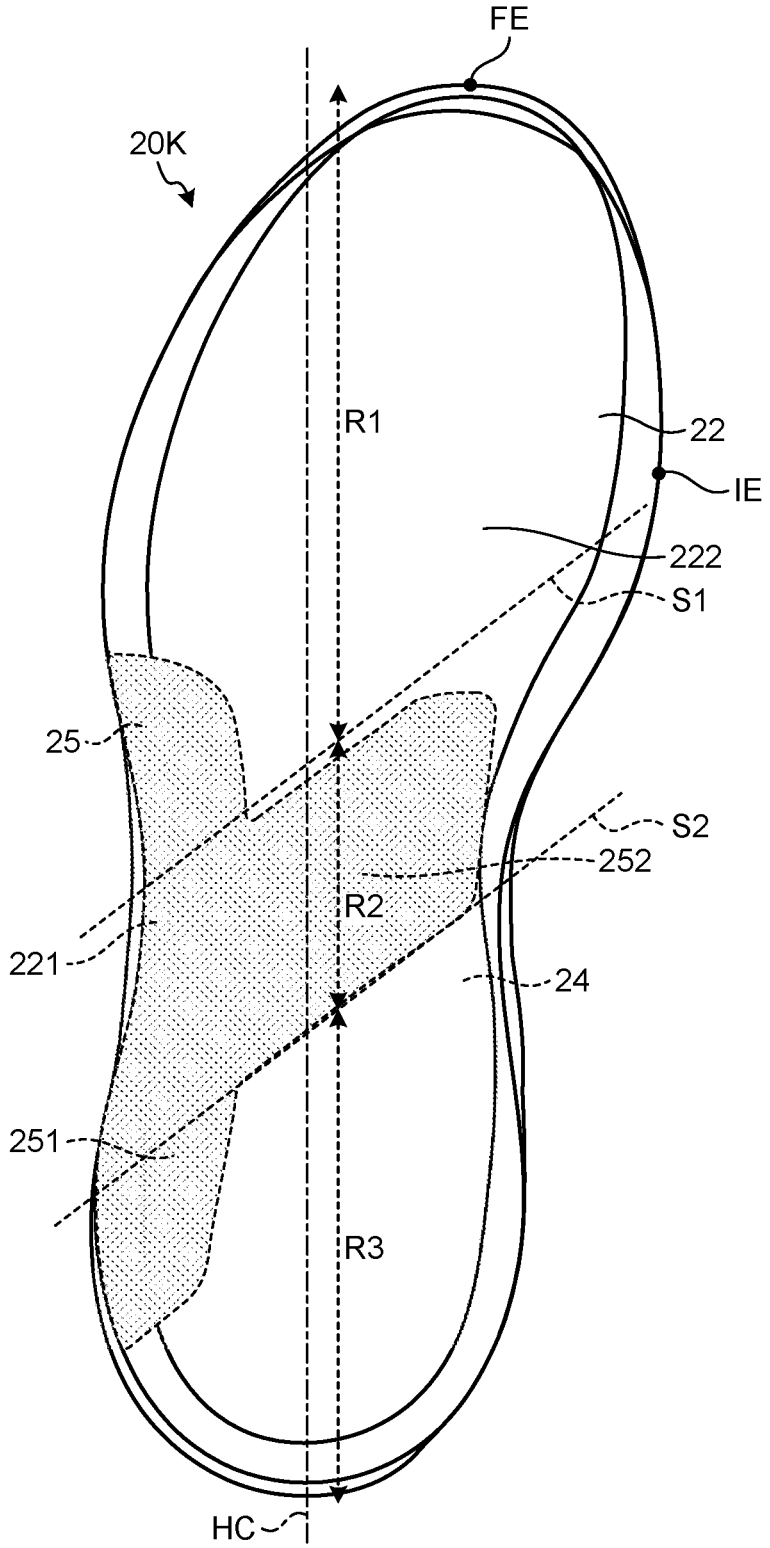
FIG. 24 is a top view of a sole according to a second embodiment.
Figure 25:
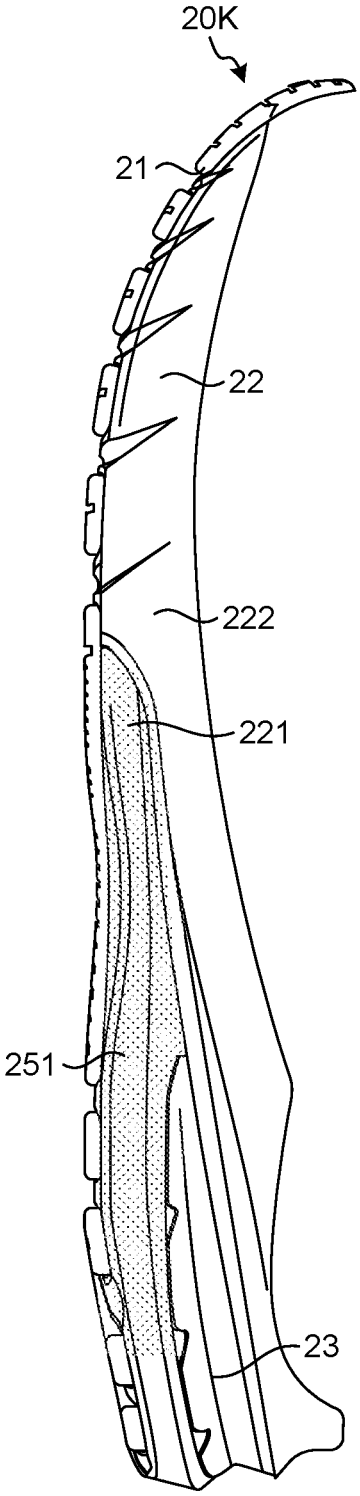
FIG. 25 is a side view of the sole on a lateral foot side according to the second embodiment.

FIG. 24 is a top view of a sole according to a second embodiment. FIG. 25 is a side view of the sole on a lateral foot side according to the second embodiment. A sole 20K according to the second embodiment is different from the sole 20A according to the first embodiment in that a first portion 251 of a torsion control portion 25 is provided on the lateral foot side and that a second portion 252 extends obliquely forward from the first portion 251. The sole 20K according to the second embodiment is used instead of the sole 20A according to the first embodiment to constitute the shoe 1A.

The first portion 251 supports the midfoot of a wearer from below on the lateral foot side, thereby preventing the heel of the wearer of the shoe 1A from falling outward. The second portion 252 supports the metatarsal bases of a wearer of the shoe 1A from below, thereby controlling torsion of the shoe 1A during running.

The first portion 251 is disposed over a part of a forefoot support portion R1 closer to the rear side, an entire midfoot support portion R2, and a part of the rearfoot support portion R3 closer to the front side. For example, the first portion 251 is disposed from a position corresponding to 40% of the dimension in the front-rear direction of the sole 20K from the front end FE of the sole 20K to a position corresponding to 90%. Note that the first portion 251 is only required to extend in the front-rear direction at least over the entire midfoot support portion R2 and may not extend to the forefoot support portion R1 and the rearfoot support portion R3. The first portion 251 is provided with a width of 15% to 45% of the dimension in the foot-width direction from the lateral-foot-side edge. As an example, the dimension of the first portion 251 in the foot-width direction is 25 mm. Note that the dimension of the first portion 251 in the foot-width direction is not limited to the exemplified value.

As illustrated in FIG. 24, the second portion 252 extends in a direction connecting a portion supporting a first metatarsal proximal end B1 and a portion supporting a fifth metatarsal proximal end B5 of a wearer with a standard body shape illustrated in FIG. 10, and is disposed in a region supporting a fourth metatarsal base C4, a third metatarsal base C3, a second metatarsal base C2, and a first metatarsal base C1. For example, the second portion 252 is provided in a region corresponding to a range surrounded by a line connecting a first position, a second position, a third position, and a fourth position. The first position corresponds to 52% of the dimension in the front-rear direction from the front end FE of the sole 20K and 65% of the dimension in the foot-width direction from the medial-foot-side end IE of the sole 20K. The second position corresponds to 46% of the dimension in the front-rear direction from the front end FE of the sole 20K and 15% of the dimension in the foot-width direction from the medial-foot-side end IE of the sole 20K. The third position corresponds to 62% of the dimension in the front-rear direction from the front end FE of the sole 20K and 12% of the dimension in the foot-width direction from the medial-foot-side end IE of the sole 20K. The fourth position corresponds to 69% of the dimension in the front-rear direction from the front end FE of the sole 20K and 58% of the dimension in the foot-width direction from the medial-foot-side end IE of the sole 20K.

In the shoe 1A configured using the sole 20K, since the first portion 251 is provided on the lateral foot side, the medial foot of a wearer sinks more easily than the lateral foot from the heel landing phase to the push-off phase. Therefore, wearing the shoe 1A configured using the sole 20K can control underpronation during running.

The configurations described in the above embodiments merely show examples of the present invention and can be combined with another known technique, and a part of each configuration can be omitted or changed without departing from the gist of the present invention. For example, the characteristic configurations described in the first embodiment and the modifications of the first embodiment can be combined with each other.

REFERENCE SIGNS LIST

1A Shoe
10 Upper
11 Upper body
12 Shoe tongue
13 Hole
16 Shoelace
20A, 20B, 20C, 20D, 20E, 20F, 20G, 20H, 20I, 20J, 20K Sole
21 Outsole
21*a*, 22*a* Upper surface
21*b* Ground contact surface
21*f* Side-surface reinforcement portion
22 Midsole
22*b* Lower surface
23 Cushion material portion
24 Cushioning portion
25 Torsion control portion
26 Protrusion
27 Recess
28 Narrowed portion
221 First layer
222 Second layer
251 First portion
252 Second portion
FE Front end
HC Heel center axis
IE Medial-foot-side end

The invention claimed is:

1. A sole having a forefoot support portion supporting a forefoot of a foot of a wearer, a midfoot support portion supporting a midfoot of the foot, and a rearfoot support portion supporting a rearfoot of the foot, the forefoot support portion, the midfoot support portion, and the rearfoot support portion being connected in this order from a front side, the sole comprising:

a midsole having cushioning property, wherein the midsole includes:

a cushioning portion formed of a first foam material; and a torsion control portion formed of a second foam material having higher hardness than the first foam material, and the torsion control portion includes: a first portion extending in a front-rear direction over at least the entire midfoot support portion on a medial foot side; and a second portion extending obliquely rearward from the first portion toward a lateral foot side.

2. The sole according to claim 1, wherein the second portion extends in a direction connecting a portion supporting a first metatarsal proximal end of the foot of the wearer and a portion supporting a fifth metatarsal proximal end of the foot of the wearer, and is disposed in a region supporting a second metatarsal base to a fifth metatarsal base of the foot of the wearer.

3. The sole according to claim 1, wherein the first portion extends rearward to the rearfoot support portion.

4. The sole according to claim 1, wherein the first portion extends in the front-rear direction with a width from a medial-foot-side edge to a portion supporting the second metatarsal base of the foot of the wearer.

5. The sole according to claim 1, wherein at least a part of the torsion control portion is formed of a non-foamed resin material having higher hardness than the first foam material.

6. The sole according to claim 5, wherein at least one of the first portion and the second portion of the torsion control portion is formed of a non-foamed resin material having higher hardness than the first foam material.

7. The sole according to claim 1, wherein the midsole has a laminated structure of a first layer including the cushioning portion and the torsion control portion, and a second layer formed of a material having lower hardness than the torsion control portion.

8. The sole according to claim 7, wherein the second layer is positioned above the first layer.

9. The sole according to claim 1, wherein the first portion has an upper surface of a medial-foot-side edge portion inclined downward toward a center in a width direction.

10. The sole according to claim 1 comprising an outsole provided below the midsole, wherein at least a part of a medial-foot-side surface of the torsion control portion is covered with the outsole.

11. The sole according to claim 1, wherein the torsion control portion has the medial-foot-side surface formed with a plurality of rib-shaped protrusions.

12. The sole according to claim 11, wherein the plurality of rib-shaped protrusions extends from an upper rear side to a lower front side.

13. The sole according to claim 1, wherein the torsion control portion has the medial-foot-side surface formed with a plurality of groove-shaped recesses.

14. The sole of the shoe according to claim 13, wherein the plurality of groove-shaped recesses extends from a lower rear side to an upper front side.

15. The sole according to claim 1, wherein the second portion includes a narrowed portion having a partially small dimension in the front-rear direction.

16. A shoe comprising: the sole according to claim 1; and an upper positioned above the sole.

17. A sole having a forefoot support portion supporting a forefoot of a foot of a wearer, a midfoot support portion supporting a midfoot of the foot, and a rearfoot support portion supporting a rearfoot of the foot, the forefoot support portion, the midfoot support portion, and the rearfoot support portion being connected in this order from a front side, the sole comprising:

a midsole having cushioning property, wherein the midsole includes:

a first member formed of a first foam material; and a torsion control portion formed of a second foam material having higher hardness than the first foam material, and the torsion control portion includes: a first portion extending in a front-rear direction over at least the entire midfoot support portion on a medial foot side; and a second portion extending obliquely rearward from the first portion toward a lateral foot side.

18. The sole according to claim 17, wherein the second portion extends in a direction connecting a portion supporting a first metatarsal proximal end of the foot of the wearer and a portion supporting a fifth metatarsal proximal end of the foot of the wearer, and is disposed in a region supporting a second metatarsal base to a fifth metatarsal base of the foot of the wearer.

19. The sole according to claim 17, wherein the midsole has a laminated structure of a first layer including the cushioning portion and the torsion control portion, and a second layer formed of a material having lower hardness than the torsion control portion.

20. The sole according to claim 17 comprising an outsole provided below the midsole, wherein at least a part of a medial-foot-side surface of the torsion control portion is covered with the outsole.

* * * * *